US012680769B2

(12) United States Patent
Zou et al.

(10) Patent No.: US 12,680,769 B2
(45) Date of Patent: Jul. 14, 2026

(54) PROCESS AND SYSTEM FOR AUTOMATED ONLINE FOULING PREVENTION OF VERTICAL SHELL AND TUBE GAS-TO-GAS HEAT EXCHANGERS

(71) Applicant: OMNI Conversion Technologies Inc., Ottawa (CA)

(72) Inventors: Xiaoping Zou, Stittsville (CA); Thomas Edward Wagler, Dunrobin (CA); Marc Bacon, Stittsville (CA); Andreas Tsangaris, Nepean (CA); Shadi Saberi, Picton (CA); Douglas Michael Feasby, Fall River (CA); Jonathan Enns, Saint John (CA); Scott Reid, Carleton Place (CA)

(73) Assignee: OMNI CONVERSION TECHNOLOGIES INC.

( * ) Notice: Subject to any disclaimer, the term of this patent is extended or adjusted under 35 U.S.C. 154(b) by 419 days.

(21) Appl. No.: 18/275,689

(22) PCT Filed: Feb. 7, 2022

(86) PCT No.: PCT/CA2022/050169
§ 371 (c)(1),
(2) Date: Aug. 3, 2023

(87) PCT Pub. No.: WO2022/165605
PCT Pub. Date: Aug. 11, 2022

(65) Prior Publication Data

US 2024/0125568 A1 Apr. 18, 2024

Related U.S. Application Data

(60) Provisional application No. 63/146,021, filed on Feb. 5, 2021.

(51) Int. Cl.
*F28G 15/00* (2006.01)
*F28G 1/16* (2006.01)

(52) U.S. Cl.
CPC ..... *F28G 15/003* (2013.01); *F28G 1/163* (2013.01)

(58) Field of Classification Search
None
See application file for complete search history.

(56) References Cited

U.S. PATENT DOCUMENTS 3,062,508 A 11/1962 Braddon
3,412,786 A * 11/1968 Taylor ..... G06G 7/48 165/95

(Continued)

FOREIGN PATENT DOCUMENTS

CA 3080901 11/2020
EP 0030459 6/1981

(Continued)

OTHER PUBLICATIONS

Search Report in corresponding European Application No. 22748775.8 mailed Nov. 26, 2024.

(Continued)

*Primary Examiner* — Jenna M Maroney
(74) *Attorney, Agent, or Firm* — Wissing Miller LLP

(57) ABSTRACT

A process and system for automated online fouling prevention of vertical shell and tube gas-to-gas heat exchangers is provided. The process and system of the invention utilize the flow velocity of the gas within the tubes to facilitate cleaning of the tubes by adding, when necessary, grit to the contaminated gas flow.

18 Claims, 14 Drawing Sheets

(56) References Cited

U.S. PATENT DOCUMENTS

| | | | | |
|---|---|---|---|---|
| 4,203,778 | A | 5/1980 | Nunciato | |
| 4,237,962 | A | 12/1980 | Vandenhoeck | |
| 4,366,855 | A | 1/1983 | Spitz | |
| 4,476,917 | A * | 10/1984 | Otake | F28G 1/12 432/2 |
| 4,482,392 | A | 11/1984 | Pollack | |
| 4,766,553 | A | 8/1988 | Kaya | |
| 5,800,246 | A | 9/1998 | Tomioka | |
| 7,493,938 | B2 | 2/2009 | Majarais | |
| 7,890,197 | B2 * | 2/2011 | Francino | F28G 1/16 700/19 |
| 8,762,106 | B2 * | 6/2014 | Miller | G05B 23/021 702/179 |
| 9,339,855 | B2 | 5/2016 | Hochfellner | |
| 11,668,488 | B2 * | 6/2023 | Revilla | F24F 11/80 165/293 |
| 2005/0133211 | A1 * | 6/2005 | Osborn | F28F 19/00 165/157 |
| 2006/0283406 | A1 * | 12/2006 | Francino | F22B 1/1846 122/379 |
| 2008/0082304 | A1 * | 4/2008 | Miller | G05B 23/021 700/275 |
| 2019/0039209 | A1 | 2/2019 | Curran | |

FOREIGN PATENT DOCUMENTS

| | | | | |
|---|---|---|---|---|
| EP | 155826 | A * | 9/1985 | |
| JP | S606354 | | 1/1985 | |
| JP | H0539902 | A * | 2/1993 | F28F 19/00 |
| WO | 2020069593 | | 4/2020 | |
| WO | WO-2024215853 | A1 * | 10/2024 | F28F 27/00 |

OTHER PUBLICATIONS

PCT International Search Report and Written Opinion for PCT/CA2022/050169, dated Jun. 1, 2022.

Office Action in corresponding Australian Application No. 2022218245 mailed Oct. 8, 2025. (3 pages).

* cited by examiner

A

B

PROCESS AND SYSTEM FOR AUTOMATED ONLINE FOULING PREVENTION OF VERTICAL SHELL AND TUBE GAS-TO-GAS HEAT EXCHANGERS

This application is a 371 of PCT/CA2022/050169, filed on Feb. 7, 2022, published on Aug. 11, 2022, under publication number WO 2022/165605, which claims priority benefits from U.S. Provisional Patent Application No. 63/146,021, filed on Feb. 5, 2021, the disclosure of each of which are incorporated herein by reference.

FIELD OF THE INVENTION

This invention pertains generally to gas-to-gas heat exchangers and, more particularly to a process and system for automated online fouling prevention of vertical shell and tube gas-to-gas heat exchangers.

BACKGROUND OF THE INVENTION

Shell and tube gas-to-gas heat exchangers are designed to cool hot and contaminated gases, while heating cleaner and colder gases. The hot gases are sent down the inside of tubes at a high velocity, while the colder gases flow on the outside of the tubes, typically through a series of baffles that support the tubes and cause the cold and clean gas to cross the tubes from the outside in multiple passes. The tube wall temperatures lie approximately midway between the temperatures of the hot and cold gases.

The design, performance, and cost of heat exchangers is significantly influenced by fouling of the heat exchanger equipment. Fouling occurs when contaminants in the contaminated gas accumulate on the tube walls at a rate that is greater than the contaminant removal rate. Fouling causes huge economic losses due to its impact on initial cost, on heat exchange operation, and on operation cost. Fouling costs for the United States and the United Kingdom are estimated to be about 0.25 percent of the countries' Gross National Product (Muller-Steinhagen, H. M., Fouling: The Ultimate Challenge for Heat Exchanger Design. The sixth International Symposium on Transport Phenomena in Thermal Engineering. 1993. Seoul, Korea).

There are several types of fouling including particulate fouling, sedimentation fouling, chemical surface fouling and corrosion fouling. Particulate fouling occurs if particles are very small in relation to surface roughness, or if they are sticky. Particulate includes soot. Soot is very small, and can coat even new tubes, as it settles in the boundary layer. Soot fouling is of concern in radiant sections of heat exchangers because it blackens the inside of tubes, increasing the tube wall temperature. Once deposits have roughened the tubes, progressively larger particulate can foul it. Inorganic compounds, tars, waxes, and ashes that are sticky can also adhere to tube walls.

Sedimentation fouling, also called precipitation fouling or crystallization fouling, occurs when dissolved inorganic salts are cooled out of the gaseous flow and condense on tube walls. For example, in combustion processes, salts exist with partial vapor pressure in the gas. Salt ions approaching a surface are attracted to it due to electromagnetic forces and settle through the boundary layer. Some of the common salts that cause fouling are $CaSO_4$, $CaCO_3$, $Mg(OH)_2$, and $SiO_2$.

Chemical surface fouling occurs when depositions are formed because of a chemical reaction that produces a solid phase at or near the surface. Carbonaceous materials can be extremely tenacious.

Corrosion fouling is similar to chemical surface fouling, but it results in the corrosion of the tube surface. The pH value of the solution is an important consideration.

When a heat exchanger is new and has smooth tubes, there is a short delay in the time required for the deposit to settle on the tube walls. The first particles to be deposited are those that are very small in relation to the surface roughness, such as soot, or those that are caused by condensation of vapors, such as molten salts. Thermophoresis forces tend to migrate particles from the gas stream to the walls. The velocities with which the particles arrive at the surface due to thermophoresis are low and therefore most of them stick to the surface. Thickening of the fine layer results in the collection of larger particles, which are transported mainly by inertial impaction.

Once deposits begin to form, the surface roughness of the tube increases, and larger particles will begin to deposit in the pits, so overall deposition rate increases. Deposits are generally less conductive than the metal tube material, so the heat transfer coefficient decreases, reducing the performance of the heat exchanger.

There are two possible outcomes from fouling. If the particles are loose enough, they will break off from the wall, and fouling will reach an asymptote when the rate of removal equals the rate of deposition. In most high temperature heat exchangers, the deposit is not friable enough to prevent continued deposit growth. In particular, where heat exchanger tube temperatures are hot enough, the deposits can age or sinter to the tube walls, making them very hard to clean; chemical surface fouling can build up hard compounds on the walls; and corrosion fouling can cause scaling.

When deposits get thick enough, they will not only reduce the heat exchange coefficient, but can increase the pressure drop in the tubes, and eventually block them.

Several methods of cleaning are used to remove fouling. They fall into two general categories, i.e., offline and online cleaning. Online cleaning is further divided into mechanical and chemical cleaning.

Offline tube cleaning may be done with steam, high-pressure water, air jets, and mechanical means such as drills equipped with scrapers or brushes. Tenacious coatings may be very hard to remove without damaging tube walls. Where corrosion, sintering, or chemical fouling has occurred, the walls may become thinner at every cleaning cycle. Since tube wall finish after cleaning is rarely as smooth as new tubes, fouling will occur more rapidly in cleaned heat exchangers than in new ones.

Where fouling reduces heat exchanger availability to the process so much as to make it uneconomical to operate, the process may require dual heat exchangers, where one heat exchanger is being cleaned while the other is in operation.

Online cleaning does not shut down the process but is often less effective than cleaning offline. Online chemical cleaning can be done with additives that reduce sedimentation fouling, chemical surface fouling, and corrosion fouling, and increase the rate of removal of particles. Unfortunately, these chemicals often contain considerable amounts of chlorine, bromine, chromium, and zinc. They add cost, are quite specific to the type of contaminants (so not as useful in refuse incinerators, gasifiers, and biomass boilers), and often are carcinogenic or hard on the environment.

Online mechanical cleaning does not have the drawbacks of using chemicals, but can add significantly to capex and complexity, and is often not effective for very high temperatures or complex fouling occurring across a wide temperature band. For example, when cooling contaminated gas from gasification from 1100° C. to 550° C. in a countercurrent heat exchanger, the fouling in the hot end of the tubes will come mostly from salts and chemical fouling, that in the middle will come mostly from sticky inorganics, and that in the cooler end will come mostly from sedimentation, and sticky condensed tars and waxes. The top and middle deposits will tend to sinter due to high temperatures, making them almost impossible to remove via online mechanical cleaning.

Online mechanical cleaning methods include mechanical vibration, sudden flow excursions, thermal shock, internal scrapers and grit blasting. There exists a need for alternative methods of online cleaning.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a process and system for automated online fouling prevention of vertical shell and tube gas-to-gas heat exchangers. In accordance with an aspect of the present invention, there is provided a process for on-line prevention of fouling of gas-to-gas heat exchanger wherein the heat exchanger is a shell and tube gas-to-gas heat exchanger having a tube side and shell side, contaminated gas flows through the tube side and clean gas through the shell side, the process comprising measuring gas temperatures, composition and flowrates; calculating a heat exchange coefficient from the measured gas temperatures, composition and flowrates in the heat exchanger to obtain a measured heat exchange coefficient; comparing the measured heat exchange coefficient to a predetermined heat exchange coefficient; and if measured heat exchange coefficient is less than the predetermined heat exchange coefficient, add grit to the contaminated gas, wherein the contaminated gas has a flow velocity in the tubes sufficient for abrasive cleaning. In some embodiments, the contaminated gas flow velocity is increased to ensure it is sufficient for abrasive cleaning.

In some embodiments of the process, the grit is pressurized grit. In other embodiments of the process, the grit is provided in a bag of friable material, as pellets or a compressed solid mass.

In some embodiments of the process, the measured temperatures include the temperature of the contaminated gas entering the tube side of the heat exchanger ($T^{hot\ in}$), the temperature of the contaminated gas exiting the tube side ($T^{hot\ out}$) the temperature of the clean gas entering the shell side ($T^{cold\ in}$) and the temperature of the clean gas exiting the shell side ($T^{cold\ out}$).

In some of embodiments of the process, the heat exchange coefficient is calculated based on the equation:

$\mu = q/A$ LMTD, where $\mu$ is the overall heat transfer coefficient, q is the heat transferred, and LMTD is the Log Mean Temperature Differential and wherein the $LMTD = (\Delta T1 - \Delta T2)/\ln((\Delta T1/\Delta T2)$, where $\Delta T1 = T^{hot\ in} - T^{cold\ out}$ and $\Delta T2 = T^{hot\ out} - T^{cold\ in}$.

In some embodiments of the process, the heat exchange coefficient is calculated in real time.

In accordance with another aspect of the invention, there is provided a system for on-line prevention of fouling of gas-to-gas heat exchanger wherein the heat exchanger is a shell and tube gas-to-gas heat exchanger having a tube side and shell side, contaminated gas flows through the tube side and clean gas through the shell side, the system comprising a grit injection apparatus, a means for measuring gas temperatures, composition and flowrates; a control system configured to receive temperature, composition and flowrate measurements from the means for measuring gas temperatures, composition and flowrates respectively, calculate a heat exchange coefficient from the measured gas temperatures, composition and flowrates in the heat exchanger to obtain a measured heat exchange coefficient; comparing the measured heat exchange coefficient to a predetermined heat exchange coefficient; and if the measured heat exchange coefficient is less than the predetermined heat exchange coefficient, signal the grit injection apparatus to add grit to the contaminated gas.

In accordance with another aspect of the invention, there is provided a system for on-line prevention of fouling of gas-to-gas heat exchanger comprising a means for measuring temperatures and flows of gases passing through the shell and tube sides of a vertical shell and tube gas-to-gas heat exchanger having the contaminated gas on the tube side and a flow velocity in the tubes sufficient for abrasive cleaning; a means for calculating the heat exchange coefficient from the measured temperatures and gas flows; a means for releasing a controlled amount of sand, slag, cyclone ash, or similar abrasive grit into the gas entering the heat exchanger in such a way that it is distributed to each tube in the exchanger when the heat exchange coefficient drops below a predetermined level that corresponds to an amount of fouling that would cause sintering or be otherwise impossible to clean via abrasive cleaning and with sufficient velocity to provide the kinetic energy required to abrade the fouled surface to reduce its thickness; a means to stop the release of said abrasive material when the heat exchange coefficient rises above a predetermined level that leaves enough fouling on the tubes to prevent abrasive wear of the tubes from the cleaning; and optionally a means of removing the abrasive injected into the gas stream.

In some embodiments, the system can be retrofitted onto existing heat exchangers to facilitate cleaning and/or reduce fouling following offline cleaning.

In accordance with another aspect of the invention, there is provided a grit injection apparatus comprising a distribution and pressure charging hopper operatively connected to a main hopper and a pressurizing gas line; at least one vertical pipe extending from the distribution and pressure charging hopper; wherein the distribution and pressure charging hopper and at least one vertical tube are configured to be pressurized; and a grit outlet pipe operatively connected to the at least one vertical pipe and extending into an upper plenum of a heat exchanger; wherein the grit injection apparatus is configured to provide pressurized grit to the upper plenum.

In accordance with another aspect of the invention, there is provided a grit injection apparatus comprising a distribution and pressure charging hopper operatively connected to a main hopper and a mechanical pressurization means; at least one vertical pipe extending from the distribution and pressure charging hopper; wherein the distribution and pressure charging hopper and at least one vertical tube are configured to be pressurized; and a grit outlet pipe operatively connected to the at least one vertical pipe and extending into an upper plenum of a heat exchanger; wherein the grit injection apparatus is configured to provide pressurized grit to the upper plenum.

In accordance with another aspect of the invention, there is provided a system for on-line prevention of fouling of gas-to-gas heat exchanger wherein the heat exchanger is a shell and tube gas-to-gas heat exchanger having a tube side and shell side, contaminated gas flows through the tube side and clean gas through the shell side, the system comprising a) a grit injection apparatus comprising a distribution and pressure charging hopper operatively connected to a main hopper and a pressurizing gas line; at least one vertical pipe extending from the distribution and pressure charging hopper; wherein the distribution and pressure charging hopper and at least one vertical tube are configured to be pressurized; and a grit outlet pipe operatively connected to the at least one vertical pipe and extending into an upper plenum of a heat exchanger; wherein the grit injection apparatus is configured to provide pressurized grit to the upper plenum; b) a means for measuring gas temperatures, composition and flowrates; and c) a control system configured to receive temperature measurements from the means for measuring temperature, receive composition measurements from the means for measuring composition, receive flowrate measurements from the means for measuring flowrate, calculate a heat exchange coefficient from measured temperatures, composition and flowrates of gases in the heat exchanger to obtain a measured heat exchange coefficient; comparing the measured heat exchange coefficient to a predetermined heat exchange coefficient; and if measured heat exchange coefficient is less than the predetermined heat exchange coefficient, signal the grit injection apparatus to add grit to the contaminated gas.

In accordance with another aspect of the invention, there is provided a system for on-line prevention of fouling of gas-to-gas heat exchanger wherein the heat exchanger is a shell and tube gas-to-gas heat exchanger having a tube side and shell side, contaminated gas flows through the tube side and clean gas through the shell side, the system comprising a) a grit injection apparatus comprising a distribution and pressure charging hopper operatively connected to a main hopper and a mechanical pressurization means; b) at least one vertical pipe extending from the distribution and pressure charging hopper; wherein the distribution and pressure charging hopper and at least one vertical tube are configured to be pressurized; and c) a grit outlet pipe operatively connected to the at least one vertical pipe and extending into an upper plenum of a heat exchanger; wherein the grit injection apparatus is configured to provide pressurized grit to the upper plenum; a means for measuring gas temperatures, composition and flowrates; and c) a control system configured to: receive temperature measurements from the means for measuring temperature, receive composition measurements from the means for measuring composition, receive flowrate measurements from the means for measuring flowrate, calculate a heat exchange coefficient from measured temperatures, composition and flowrates of gases in the heat exchanger to obtain a measured heat exchange coefficient; comparing the measured heat exchange coefficient to a predetermined heat exchange coefficient; and if measured heat exchange coefficient is less than the predetermined heat exchange coefficient, signal the grit injection apparatus to add grit to the contaminated gas.

In accordance with another aspect of the invention, there is provided a heat exchange system comprising a) a shell and tube gas-to-gas heat exchanger having a tube side and shell side, wherein hot contaminated gas flows through the tube side and clean gas through the shell side; b) at least one grit injection apparatus, each grit injection apparatus comprising a distribution and pressure charging hopper operatively connected to a main hopper and a pressurizing gas line; c) at least one vertical pipe extending from the distribution and pressure charging hopper; wherein the distribution and pressure charging hopper and at least one vertical tube are configured to be pressurized; and d) a grit outlet pipe operatively connected to the at least one vertical pipe and extending into an upper plenum of a heat exchanger; wherein the grit injection apparatus is configured to provide pressurized grit to the upper plenum; e) a means for measuring gas temperatures, composition and flowrates; and f) a control system configured to: receive temperature measurements from the means for measuring temperature, receive composition measurements from the means for measuring composition, receive flowrate measurements from the means for measuring flowrate, calculate a heat exchange coefficient from measured temperatures, composition and flowrates of gases in the heat exchanger to obtain a measured heat exchange coefficient; comparing the measured heat exchange coefficient to a predetermined heat exchange coefficient; and if measured heat exchange coefficient is less than the predetermined heat exchange coefficient, signal the grit injection apparatus to add grit to the contaminated gas.

In accordance with another aspect of the invention, there is provided a heat exchange system comprising a) a shell and tube gas-to-gas heat exchanger having a tube side and shell side, wherein hot contaminated gas flows through the tube side and clean gas through the shell side; b) at least one grit injection apparatus, each grit injection apparatus comprising a distribution and pressure charging hopper operatively connected to a main hopper and a mechanical pressurization means; c) at least one vertical pipe extending from the distribution and pressure charging hopper; wherein the distribution and pressure charging hopper and at least one vertical tube are configured to be pressurized; and d) a grit outlet pipe operatively connected to the at least one vertical pipe and extending into an upper plenum of a heat exchanger; wherein the grit injection apparatus is configured to provide pressurized grit to the upper plenum; e) a means for measuring gas temperatures, composition and flowrates; and f) a control system configured to receive temperature measurements from the means for measuring temperature, receive composition measurements from the means for measuring composition, receive flowrate measurements from the means for measuring flowrate, calculate a heat exchange coefficient from measured temperatures, composition and flowrates of gases in the heat exchanger to obtain a measured heat exchange coefficient; comparing the measured heat exchange coefficient to a predetermined heat exchange coefficient; and if measured heat exchange coefficient is less than the predetermined heat exchange coefficient, signal the grit injection apparatus to add grit to the contaminated gas.

BRIEF DESCRIPTION OF THE DRAWINGS

These and other features of the invention will become more apparent in the following detailed description in which reference is made to the appended drawings.

DETAILED DESCRIPTION OF THE INVENTION

Figure 1:
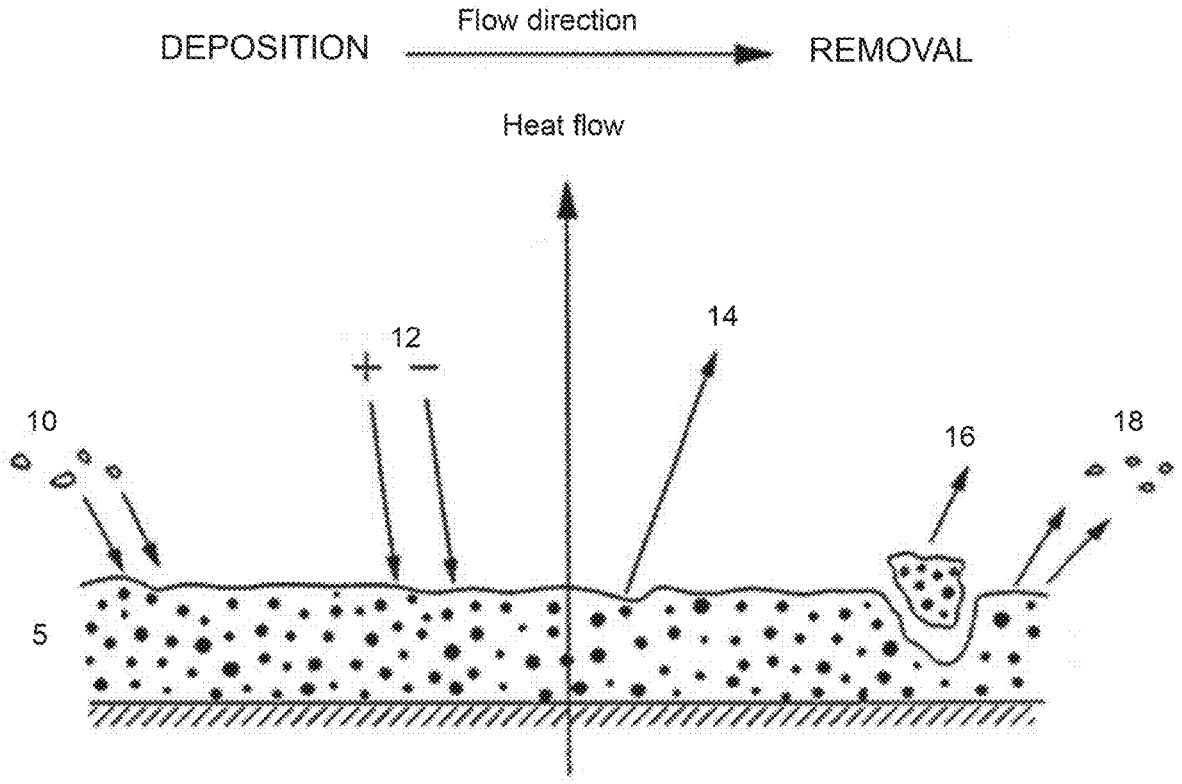
FIG. 1 illustrates the various deposition and removal processes during fouling. Processes that deposited material (5) onto the heat transfer surface include sedimentation of particles (10); and crystallization ions (12). Processes that result in the removal of deposited material (5) on the heat transfer surface include dissolution (14), spalling (16) and erosion (18).

The invention provides a method and system for on-line prevention of fouling of gas-to-gas heat exchangers and in particular, shell and tube gas-to-gas heat exchangers. Shell and tube heat exchangers have a shell with a bundle of tubes inside it and gas or fluids starting at different temperatures flow through the tubes (tube side) and outside the tubes but within the shell (shell side). Shell and tube heat exchangers may be used to transfer heat from contaminated gas streams passing through the tubes to a clean gas stream that pass through the shell side.

Various configurations of shell and tube heat exchangers are known in the art. In some embodiments, the shell and tube heat exchangers are configured such that the tubes are vertical oriented straight tubes, with the contaminated gas flowing in one direction, optionally from the top to the bottom. Contaminated hot gas is inputted to the first end of each tube via an inlet plenum. Cooled contaminated hot gas is outputted into the outlet plenum. The tubes are connected at each end to the plenums by a tubesheet. The tubesheet has a series of holes sized to hold the tubes. The clean gas on the shell side may be in a co-current, countercurrent, or cross-flow configuration and entries through a shell-side input and exists through a shell side output. The gas path on the shell side is optionally controlled by one or more baffles.

During use, the contaminates in the contaminated hot gas can be deposited on the walls of the tubes impacting heat exchange efficiency. The method and system of the invention utilize the flow velocity of the gas within the tubes to facilitate cleaning of the tubes by adding, when necessary, grit to the contaminated gas flow. The grit propelled by the gas stream removes deposits from the inside of the tubes.

The grit introduced into the gas stream is hard, resistant to melting at the temperatures of the hot gas, non-reactive with the contaminants in the hot gas and preferably have sharp edges to cut away the fouling. Particle size is selected to be in a range that is large enough to impart sufficient kinetic energy to dislodge contaminates from the surface of the tubes but small enough to avoid damaging the surface of the tubes. In some embodiments, the method utilizes a grit injection apparatus. Optionally, the grit injection apparatus includes a means of selecting or limiting particle size of the injected grit.

In some embodiments, the system and method are configured to provide particles of different sizes and shaped depending on the level of fouling in the tubes. In such embodiments, the means of selecting or limiting particle size of the injected grit is optionally provided.

In alternative embodiments, grit is manually added to the upper plenum of the heat exchanger. Optionally, the grit is packaged in a bag of friable organic or inorganic material. The bag is dumped under gravity onto the upper tube sheet of the heat exchanger. The bag is made of such material that quickly disintegrate during exposure to high temperatures in the upper plenum. As a result, the grit is released from the bundle, covers the tubesheet and flows through the tubes. The bag material can remain as solid particles and act as additional grit material or can vaporize and flow though the tubes along with the gas. Optionally, the grit is pelletized or compressed to a solid mass. The mass is dumped onto the tube sheet and disintegrate to particles upon impact.

In some embodiments, grit is obtained from the processes that produced the contaminated gas. For example, the grit is optionally a crushed slag byproduct of a gasification process or ash recovered from a cyclone. In alternative embodiments, grit is sand or another inert hard material or combination of materials. Optionally, a combination of grit material is used. In some embodiments, the system and method are configured to use more than one type of grit material. Optionally, the type of grit material used may be selected based on level of fouling in the tubes.

Optionally, grit introduced into the tubes and the material abraded from the tube walls is recycled into additional grit for use in the system and processes. In such embodiments, grit and the abraded material may be added to the upstream processes to be incorporated into slag that is crushed to the appropriate size.

Grit injection may be continuous during operation of the heat exchanger to limit fouling or may be response to changes in heat exchanger performance.

In embodiments where grit injection is controlled in response to heat exchanger performance and/or changes performance, performance is measured by assessing the transfer of heat from the hot contaminated gas to the clean gas. Methods of evaluating heat exchanger efficiency are known in the art and include the Log Mean Temperature Difference (LMTD). In some embodiments, performance of the heat exchanger is compared to predicted ideal heat exchanger performance. In such embodiments, grit injection is triggered when actual performance deviates by a predetermined level. In other embodiments, heat exchanger performance is compared to one or more actual previously determine heat exchanger performance, optionally the actual previously determine heat exchanger performance is when the heat exchanger was first brought on-line. In such embodiments, grit injection is triggered when current actual performance deviates by a pre-determined level from previous performance.

Heat exchanger performance including by determining heat exchange coefficient may be measured continuously, at set intervals or in response to user input. Optionally, the performance is measured in real time.

In some embodiments, changes in heat exchanger performance are tracked over time and an estimate of operational life is provided. In such embodiments, an alert may be sent when operational life is below a pre-determined time.

The system comprises or is operatively associated with a set of thermocouples to measure temperature of at least inputted gases and outputted gases.

In one embodiment, there is provided temperature measurement of the following points on a vertical gas-to-gas heat exchanger, the hot contaminated gas entrance in the plenum at the top of the tubes, the cooled contaminated gas exit in the plenum at the bottom of the tubes, the cool clean gas entrance on the shell side at the bottom of the tubes and the heated clean gas exit on the shell side at the top of the tubes. Optionally, temperatures may be measured at additional points in the heat exchanger.

In some embodiments, one or more thermocouples are provided at each point. Optionally, three thermocouples are provided at each point. In some embodiments, each group of thermocouples is arranged to have voting logic, i.e., the correct temperature is assumed to be the average of the two closest readings in the three thermocouples. Optionally, if any thermocouple deviates by more than a prescribed amount from the other thermocouples in the group, an error message is sent to the operator to have the thermocouple replaced at the earliest convenience.

A heat exchange coefficient is calculated from measured temperatures, composition and flowrates of gases in the heat exchanger to obtain a measured heat exchange coefficient and compared to a predetermined heat exchange coefficient. If the measured heat exchange coefficient is less than the predetermined heat exchange coefficient, grit is added to the contaminated gas.

In some embodiments, the system and method are configured to determine the overall heat transfer coefficient using the equation: $\mu=q/A$ Log Mean Temperature Differential (LMTD), where $\mu$ is the overall heat transfer coefficient, q is the heat transferred, and LMTD.

The Log Mean Temperature Differential is calculated by the following equation:

$$LMDT=(\Delta T1-\Delta T2)/\ln((\Delta T1/\Delta T2), \text{ where} \quad a.$$

$$\Delta T1=T^{Hot\ In}-T^{Cold\ Out} \text{ and } \Delta T2=T^{Hot\ Out}-T^{Cold\ In} \quad b.$$

The heat transferred (q) is calculated by $q=Cp\Delta t$ for the gas on each side of the tube, where Cp is the published heat capacity at constant pressure for the gas mixture and $\Delta t$ is the temperature change of the gas.

In some embodiments, the overall heat transfer coefficient is compared to the overall heat transfer coefficient for the new condition for given flow rates.

In some embodiments, the heat given up by the heat exchanger shell is calculated and the heat transfer coefficient is corrected. Optionally, the heat given up by the heat exchanger shell is calculated based on the heat conductivity of the shell and its surface area.

Generally, the heat given up by the hot gas in the tubes should be identical within a small margin of error with the heat accepted by the cold gas on the shell side plus any heat loss by the heat exchanger shell. If not, optionally the inputs (temperatures, flows, gas compositions, shell losses) are verified and corrected.

In some embodiments, the measurements and the calculations are in real time using an appropriate automated control system.

When the tubes begin to foul, the overall heat transfer coefficient drops. In some embodiments, when the overall heat transfer coefficient drops below a pre-set limit, the control system will respond by initiating grit injection.

Alternatively, grit injection is continuous, semi-continuous, or cyclic where a finite, predetermined amount of grit is injected into the inlet gas stream. Injection of grit is repeated at given time intervals or continually until the heat exchange coefficient rises to an acceptable limit or during operation.

In embodiments, where a continuous amount of grit is injected into the gas stream to reduce fouling the control system is optionally configured to increase the amount of grit injected if an increase in fouling is detected.

Optionally, the pre-set limit is based on the level of fouling that is less than the amount that will cause transition from a fluffy surface to a sintered surface.

In some embodiments, the control system is further configured to stop or reduce grit injection when overall heat transfer coefficient rises above a threshold level.

The control system regulates grit injection. In some embodiments, the control system provides a signal to the grit injection system to initiate introduction of a metered amount grit, optionally selected from crushed slag, sand, and cyclone ash, or similar abrasive grit into the contaminant hot gas entering the heat exchanger plenum. The grit is introduced upstream of the plenum such that it remains entrained in the gas stream and is dispersed evenly into the tubes and has sufficient kinetic energy to remove the fouling material.

Figure 2:
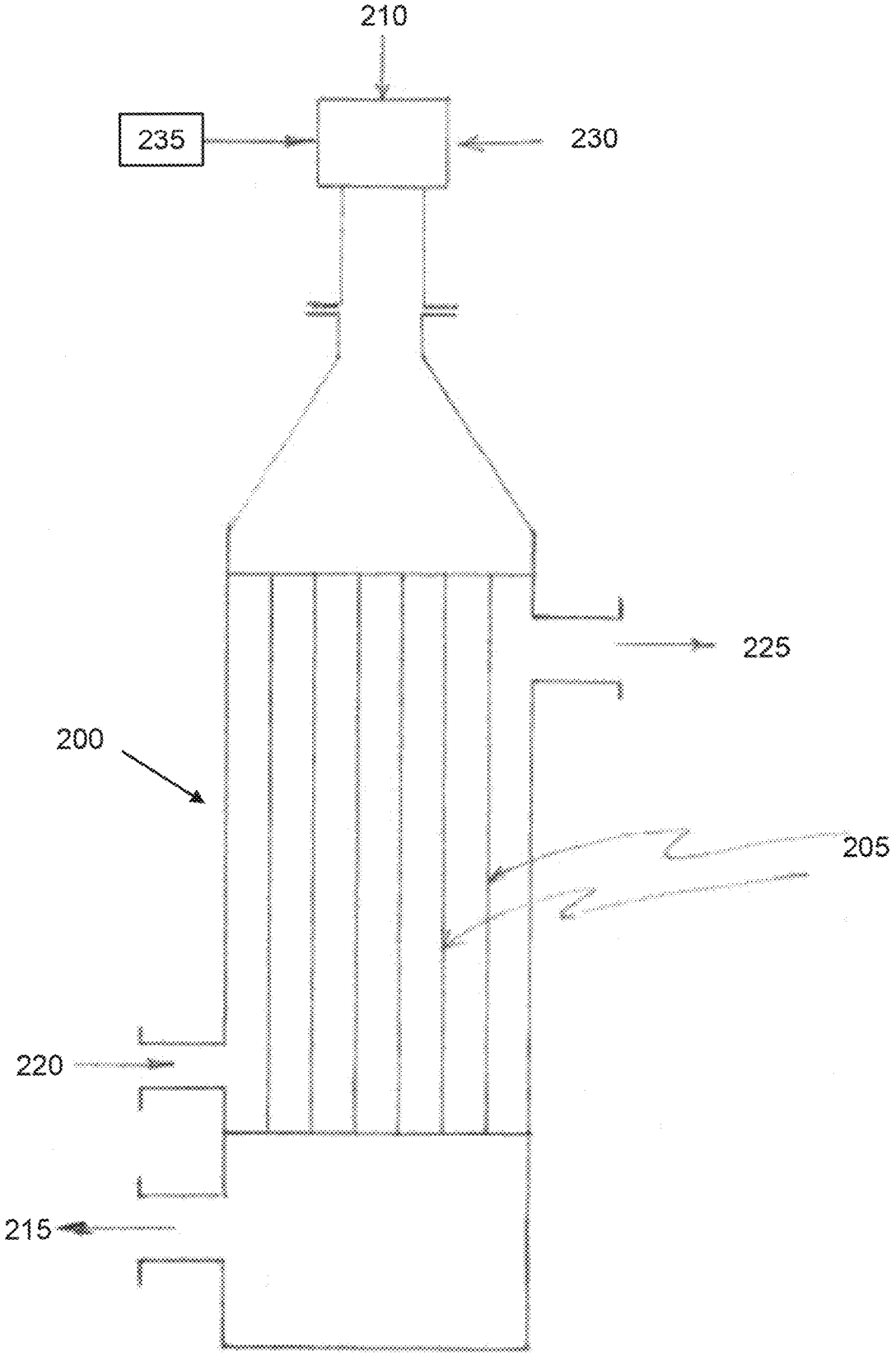
FIG. 2 illustrates one embodiment of a shell and tube heat exchanger with grit injection into dirty gas stream. The shell and tube heat exchanger receives dirty hot gas through a vertical inlet hot gas pipe (210) which is axially aligned with the heat exchanger (200) and enters the heat exchanger tubes (205). Grit input (230) which receives grit from a grit source (235), dirty gas output (215), clean gas input (220), and clean gas output (225).
Figure 3:
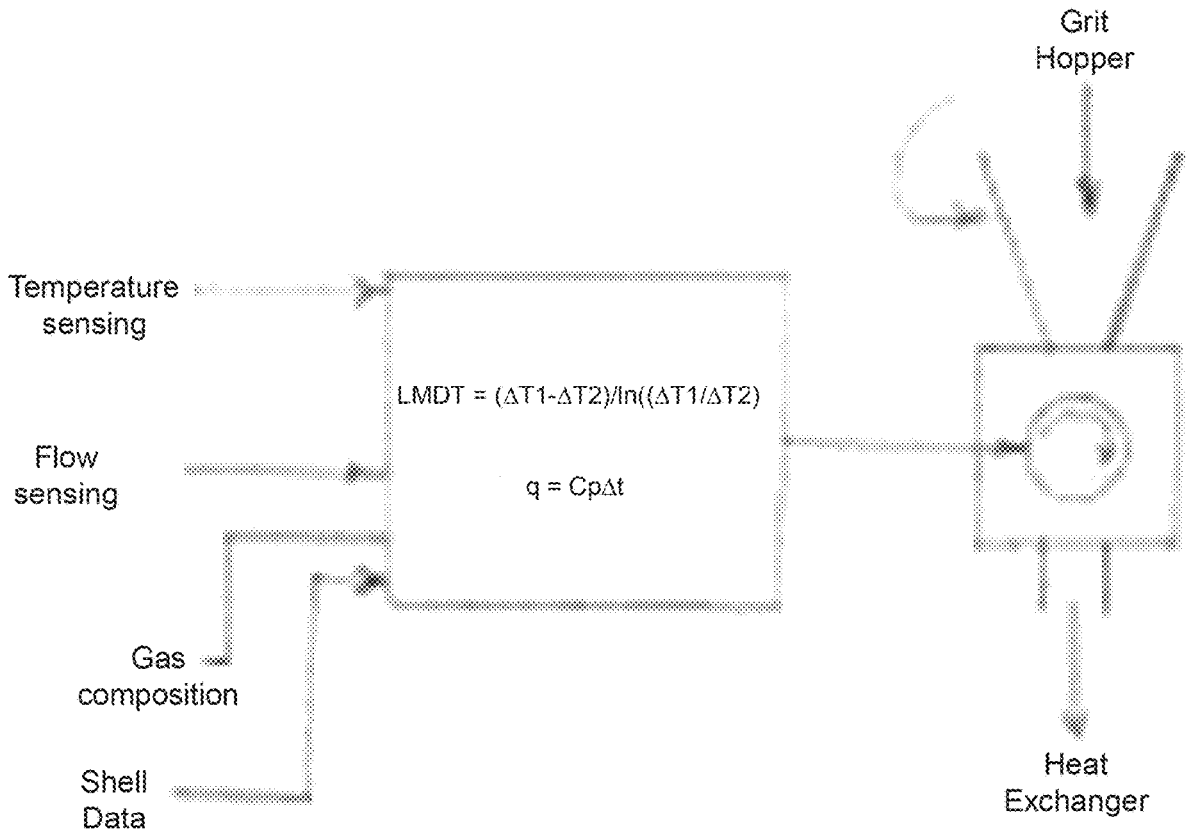
FIG. 3 is a schematic detailing the control system for sensing fouling and managing grit injection in accordance with one embodiment of the invention.

In some embodiments, the grit injection apparatus is configured to be operatively associated with a heat exchanger with a vertical inlet hot gas pipe which is axially aligned with the heat exchanger such as the one shown in FIG. 2.

Figure 4:
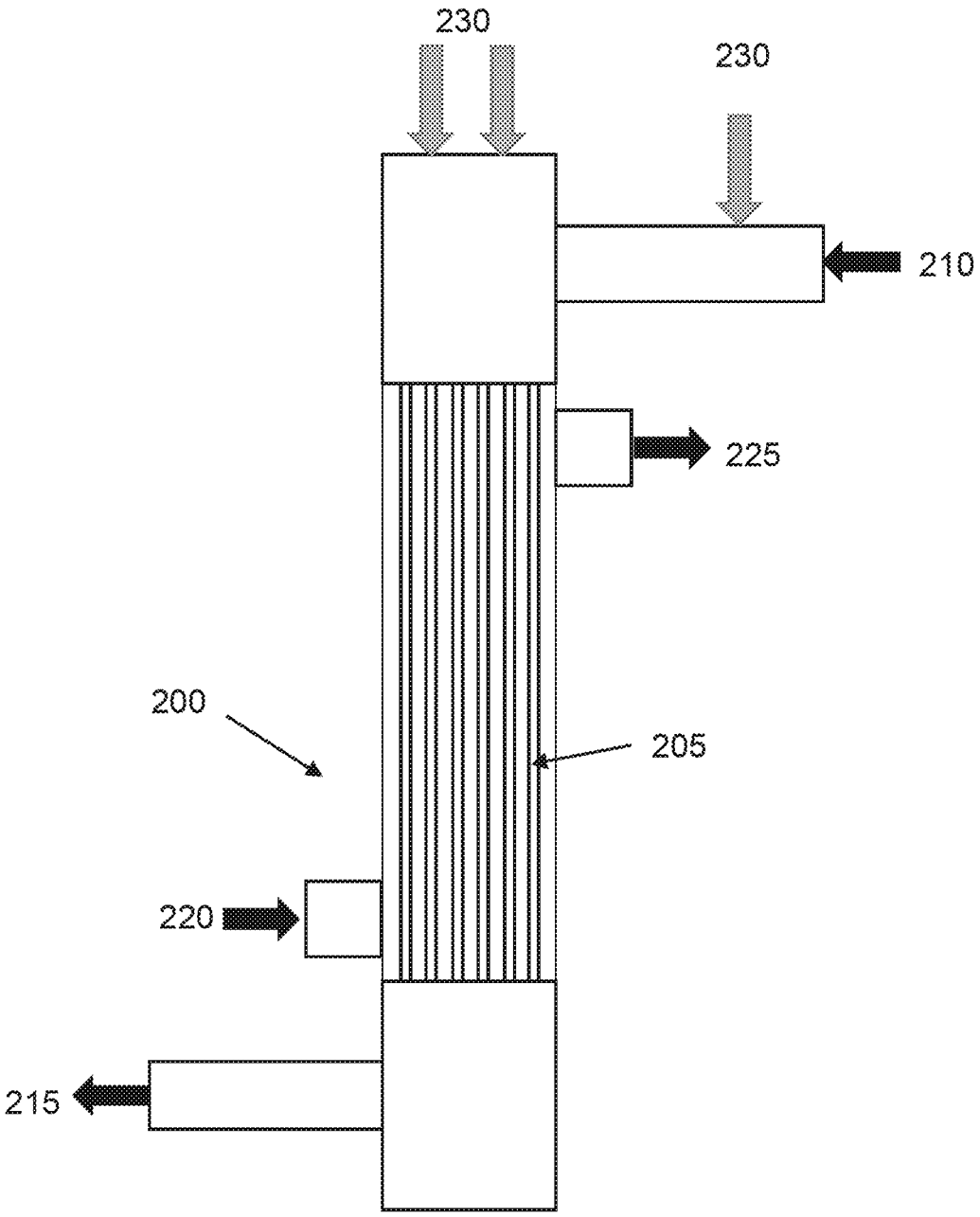
FIG. 4 illustrates a shell and tube heat exchanger (200) with a side entrance for the dirty hot gas (210) and alternatives inputs (230) for grit injection in accordance with one or more embodiments of the invention. Also shown are the tubes (205), dirty gas output (215), clean gas input (220), and clean gas output (225).

In an alternative embodiment, the grit injection apparatus is configured to be operatively associate with a heat exchanger having a hot gas inlet pipe at the side as illustrated in FIG. 4. In this embodiment, the grit is added to the inlet pipe upstream of the heat exchanger upper plenum and/or into the hot gas inlet plenum. The grit mixes with the inputted hot gas and carried into the tubes.

When introduced into the top of a hot, contaminated gas stream above the heat exchanger plenum, grit may deposit on the top tubesheet between the tubes and form a shaped entry into the top of the tubes that approximates the flow lines of acceleration from the channel to the tubes.

Grit introduced into the tubes will initially be travelling slower than the inputted gas as gas velocity increases as the gas enters the tubes due to the sudden contraction at the entrance of the tube. Introduction of grit perpendicular or otherwise non-parallel to the tube direction may aid in removing deposited material near the top of the tubes. The material removed will be added to the grit and will adhere further down or be carried away.

Further along the tube, the gas bulk velocity is aligned with the tubes and the axial flow becomes dominant. However, the interaction between the highly turbulent gas flow creates a driving force that continues to throw small grit particles at the tube walls. The larger particles interact with turbulence to a lesser extent, but still, due to the difference between local gas and particles velocities constantly accelerate and decelerate. The fluctuating particle velocities result in collisions between them that cause deflection of a fraction of these particles towards the wall, contributing to the deposit removal through inertial impaction.

As the contaminated gas cools, its volume is reduced which may result in increased fouling of the tubes. In vertically oriented heat exchanges, while the gas flow decelerates, its dragging action on the grit particles is reduced. At the same time, the gravity forces keep acting on the particles and become more dominant resulting in a higher particulate velocity than gas velocity providing additional cleaning of the tubes all the way to the bottom.

The grit can be injected from a single or multiple locations. The grit inputs include nozzles, ducts, conduits, pipes, holes or orifices of suitable size and shape through which the grit particles can be introduced to the gas flow. In some embodiments, the grit input includes one or more valves and/or is operatively associated with one or more grit hoppers.

The number, location, size, and angle of the grit inputs are selected based on the desired grit distribution pattern. In some embodiments, a relatively uniform grit distribution is desired. In such embodiments number, location, size, and angle of the grit inputs are selected such that a relatively uniform grit distribution is achieved across the whole cross section of the heat exchanger.

Fouling of the heat exchanger tubes may not happen uniformly. This is due to two main factors: (1) some tubes may receive more flow than the others and (2) tube temperatures along the tube length may not evolve in an identical manner for all the tubes. This means the flow in some of the tubes may start to cool down at a faster rate, which causes fouling to occur at an increased rate. Injection of more grit into the tubes that are prone to increased fouling would be beneficial. Accordingly, in some embodiments, the grit can be injected intentionally in a non-uniform manner such that more grit is directed into the tubes that have faster fouling rate. Optionally, one or more grit inputs are positioned preferentially above the tubes that are more prone to fouling. In some embodiments, the sequence and amount of the grit injected into those tubes are such that a more effective cleaning can be achieved in those tubes.

In some embodiments, velocity at which grit is inputted is controlled.

In vertically-oriented heat exchangers, grit particles released from the grit input(s) into the heat exchanger upper plenum are subject to two main forces: gravitational force that contributes to the downward fall of the particles, and drag forces exerted by the gas flow that cause entrainment and dispersion of the particles in the gas. When the gas flow enters the upper plenum axially and fully aligned with the heat exchanger tubes, the gravitation force and the flow direction are aligned and the particles take a more or less vertical path towards the entrances of the heat exchanger tubes and are uniformly distributed across the heat exchanger.

When the gas flow partially or substantially deviates from the axial direction at the entrance to the upper plenum, some or most of the particles are laterally entrained with the gas. In this case, unless the particles are excessively large or heavy, the gravitational force is not adequate to straighten the path of the particles and may lead to a preferential deposition of the particles across the heat exchanger.

In some embodiments, the invention provides a method and system for grit injection that are minimally or not influenced by gas entrance effects and/or flow patterns in the upper plenum. In such embodiments, grit inputs are pressurized during injection such that the grit particles are accelerated and reach high velocities. The inertia of these high velocity particles overcomes the drag forces, keeping the particles on a substantially straight trajectories before they reach the tubes. In such embodiments, the grit inputs can further be configured to direct the particles towards the entrances of the tubes.

In some embodiments, the grit injection apparatus is configured to distribute grit over the whole area where the tube entrances. Substantially full grit coverage may be provided in a single or multiple grit injections. Multiple grit injections can be provided sequentially or simultaneously.

In some embodiments, the grit injection apparatus comprises at least two grit inputs. In such embodiments, the grit injections may be substantially simultaneous or sequentially. If three or more grit inputs are provided the grit injections may be substantially simultaneous or sequentially or a combination of both simultaneous and sequential where at least two of the at least three grit inputs inject grit at the same time.

The grit injection pressure is selected to be high enough to overcome the gas phase inertia, as well as the friction forces in the input but below a pressure that causes damage to the internals of the heat exchanger and the injection system.

In some embodiments, the pressure is provided by a gas that is compatible with downstream processes including carbon dioxide, nitrogen, steam or inert gases. In alternative embodiments, other means of creating pressure or force can be used to accelerate the grit particles. For example, mechanical pressure via a piston, plunger or other mechanical actuator can be used to pressurize and accelerate the grit.

Computational Fluid Dynamics (CFD) simulation may be used to determine the optimal design for each embodiment such that the effect of inlet flow pattern does not affect the uniformity of grit distribution over the heat exchanger cross section.

The range of suitable grit injection velocities may be determined by performing a series of injection trials using CFD simulations in which the grit injection velocities are gradually increased until a satisfactory coverage is achieved.

Grit Addition System:

The grit addition system comprises grit transportation means configured to transport grit to the heat exchanger, grit hopper, grit injection apparatus and optional control system. In some embodiments, the control system is a component of a larger control system.

Grit Transportation Means:

The grit transportation means comprises one or more conveyors configured to transport grit from one or more sources to one or more grit hoppers. Appropriate grit includes a crushed slag by-product of a gasification process, ash recovered from a cyclone, sand or another inert hard material or combination of materials.

Appropriate conveyors are known in the art and include augers including flexible augers and drag chain conveyor. Alternative, pneumatic transport may be used to transport grit from its source.

In some embodiments, the grit transportation means conveys the grit from a process source, for example, slag crusher outlet, or from a grit storage area or conveyor loading area to one or more hoppers.

In one embodiment, sacks of grit, optionally weighing approximately 1000 kg, are loaded into a bulk-bag unloader stand, located at ground level, via a forklift. The bottom of the unloader stand contains a small hopper with an agitator installed to maintain easy grit discharge from the hopper and into a flexible screw conveyor or other conveying mechanism. An overall elevation change of approximately 30 meters is required to convey the grit to a set of 3 intermediate hoppers, located above the vertically-oriented heat exchanger inlet duct.

Grit Hopper(s)

The Grit Addition System includes one or more grit hoppers sized to hold sufficient grit for a specific period of operation. Size of the hopper is in part determined based on source of grit. If the hopper is continual replenished directly from a source, the hopper may be of smaller size.

In one embodiment, the hoppers are sized such that they can hold sufficient grit to allow for 6 hours of holdup between refills.

In one embodiment, the hopper(s) has a single central outlet, optionally with a conical section to facilitate gravity-fed grit flow out of the bins when the process calls for grit addition.

In one embodiment, one main hopper is connected to one distribution hopper via a metering valve or a metering screw.

In one embodiment, one main hopper is connected to two or more distribution hoppers via metering valves or metering screws.

Grit Injection Apparatus

Grit is inputted into the heat exchanger by grit injection apparatus operatively connected to one or more grit hoppers and may include nozzles, ducts, conduits, pipes, holes or orifices of suitable size and shape through which the grit particles can be introduced to the gas flow.

Figure 5:
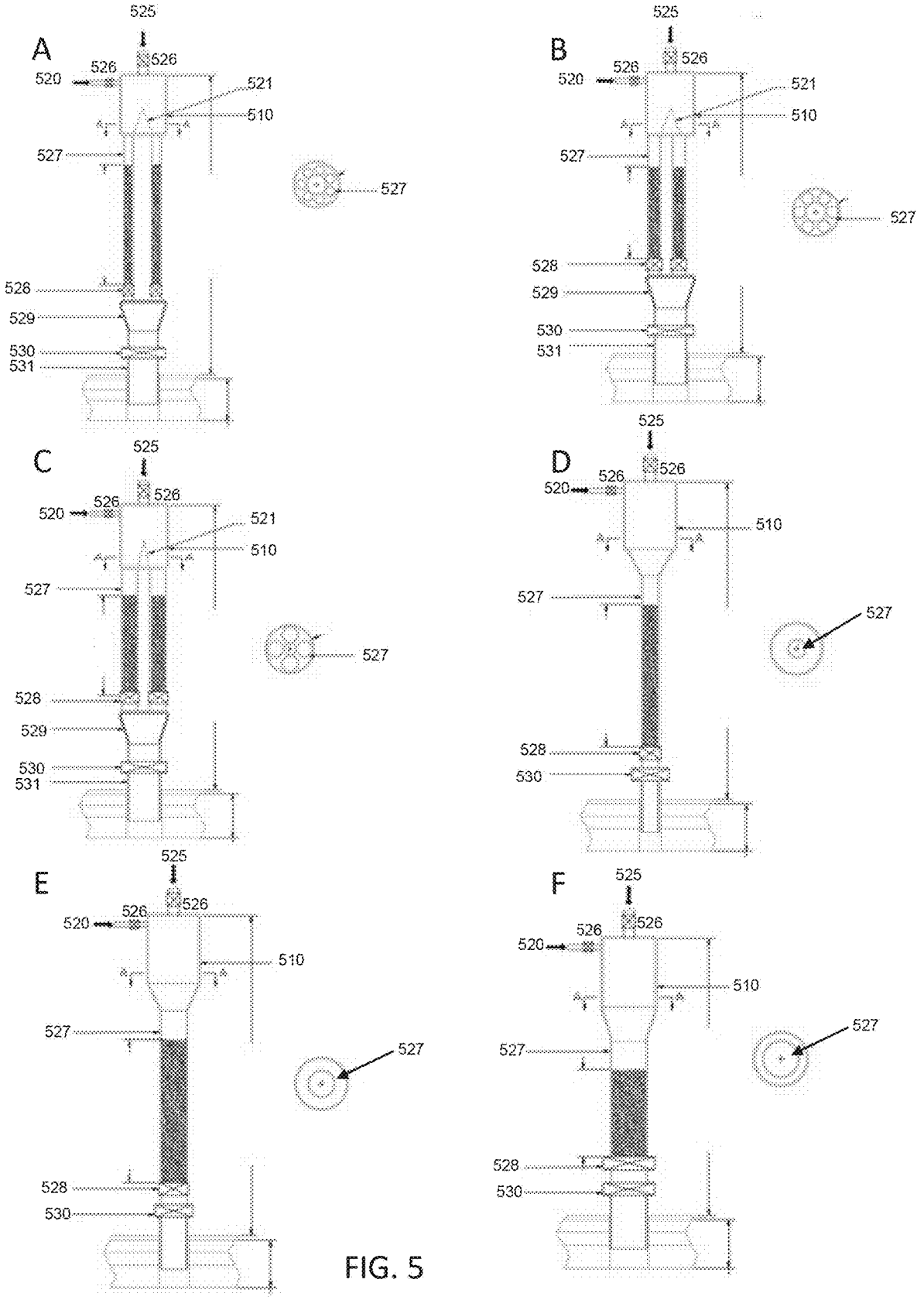
FIG. 5 illustrates six different grit injection apparatus. A) shows a grit injection apparatus comprising a distribution and pressure charging hopper (510) operatively connected to a main hopper (not shown) and a pressurizing gas line (520) with valve (526). The connection (525) to the main hopper is equipped with a valve (526). The distribution and pressure charging hopper (510) includes a steel cone (521) to facilitate distribution of grit to the vertical pipes (527). Seven vertical pipes (527) (only two shown for clarity) extend from the distribution and pressure charging hopper outlet to a fast-acting valves (528) to facilitate pressurization. A reducer (529)(optional in some embodiments), isolation valve (530) and pipe (531) through insulation and refractory of heat exchanger to upper plenum of the heat exchanger are also shown. B) shows a grit injection apparatus with six vertical pipes (527) (only two shown). B) shows a grit injection apparatus with four vertical pipes (527) (only two shown). C) shows a grit injection apparatus with a single vertical pipe (527). D) shows an alternative grit injection apparatus with a single vertical pipe (527). E) shows an alternative grit injection apparatus with a single vertical pipe (527). F) shows an alternative grit injection apparatus with a single vertical pipe (527).

Referring to FIG. 5, in one embodiment, the grit injection apparatus comprises a distribution and pressure charging hopper operatively connected to a main hopper (not shown) and a pressurizing gas line. The connection to the main hopper is equipped with a valve. One or more vertical pipes extend from the distribution and pressure charging hopper outlet to a fast-acting valve to facilitate pressurization, an optional reducer and isolation valve. Appropriate valves are known in the art and include rotary valves.

The configuration of the distribution and pressure charging hopper may be modified based on the number of vertical pipes and may include a distribution cone or otherwise configured to direct grit to the one or more vertical tubes.

In some embodiments, one vertical pipe extends from the distribution and pressure charging hopper.

In other embodiments, there is a plurality of vertical pipes extending from the distribution and pressure charging hopper. In some embodiments, there are two vertical pipes, three vertical pipes, four vertical pipes, five vertical pipes, six vertical pipes, seven vertical pipes or eight or more vertical pipes.

The diameter of the one or more vertical pipes may be varied according to type of grit used and application.

In some embodiments, a reducer is provided downstream of the fact acting valves to reduce the diameter of one or more vertical pipes.

A pipe segment that is inserted into the heat exchanger upper plenum through a hole in the refractory or other constituting material connects the grit injection apparatus to the heat exchanger at the lower end.

Method

Material is deposited on the walls of the tubes in the heat exchanger over time resulting in a detectable reduction in heat exchange coefficient.

In some embodiments, when the heat exchange coefficient drops below a threshold value a grit addition sequence is initiated. The control system sends a signal to the grit addition sequence controller to request grit and grit is added.

To inject grit using the grit injection apparatus of FIG. 5, the isolation valve is closed for normal operation. The one or more fast-acting isolation valves located directly upstream of the isolation valve is also closed in order that the desired volume of sand is held up above this valve when required. The valve from the pressurization line is also closed.

The valve from the metering line is opened and sand is metered into the distribution hopper by means of a conveyor or a rotary valve by gravity feed from above. Once the required volume or level is achieved in the distribution hopper the metering valve is closed and the distribution hopper is pressurized. The pressure provides the motive force to inject the grit into the upper plenum of the heat exchanger. Nitrogen, carbon dioxide, or steam or other compressible gases is used for pressurization.

Optionally, the injection pressure is between 2 and 50 psig, preferably between 5 and 20 and more preferably, between 10 and 15 psig. In one embodiment, the injection pressure is 15 psig.

Once the required pressure has been reached in the distribution hopper, the supply valve for the gas is closed, the lower isolation valve is opened, and the fast-acting valve can be opened to discharge the grit. The grit will achieve the desired velocity due to the driving force of the pressure in the hopper and the pipe and enter the heat exchanger tubes.

Grit entering the heat exchanger tubes flows through the heat exchanger tubes and falls vertically along the flow path, with the normal syngas flow. The grit acts as a mechanical separation mechanism to remove deposits from the heat exchanger tubes, which allows for the heat transfer to improve.

After the grit has been discharged the isolation valve and the fast-acting valve are closed and the cycle can be repeated.

Optionally, the grit introduced into the tubes and the material abraded from the tube walls is removed from the contaminated gas stream. This can be done with a cleanout port or auger in the lower chamber of the heat exchanger for large particulate and with downstream gas cleaning via scrubbing, baghouses, cyclones, or electrostatic precipitators as appropriate to the gas stream.

Figure 6:
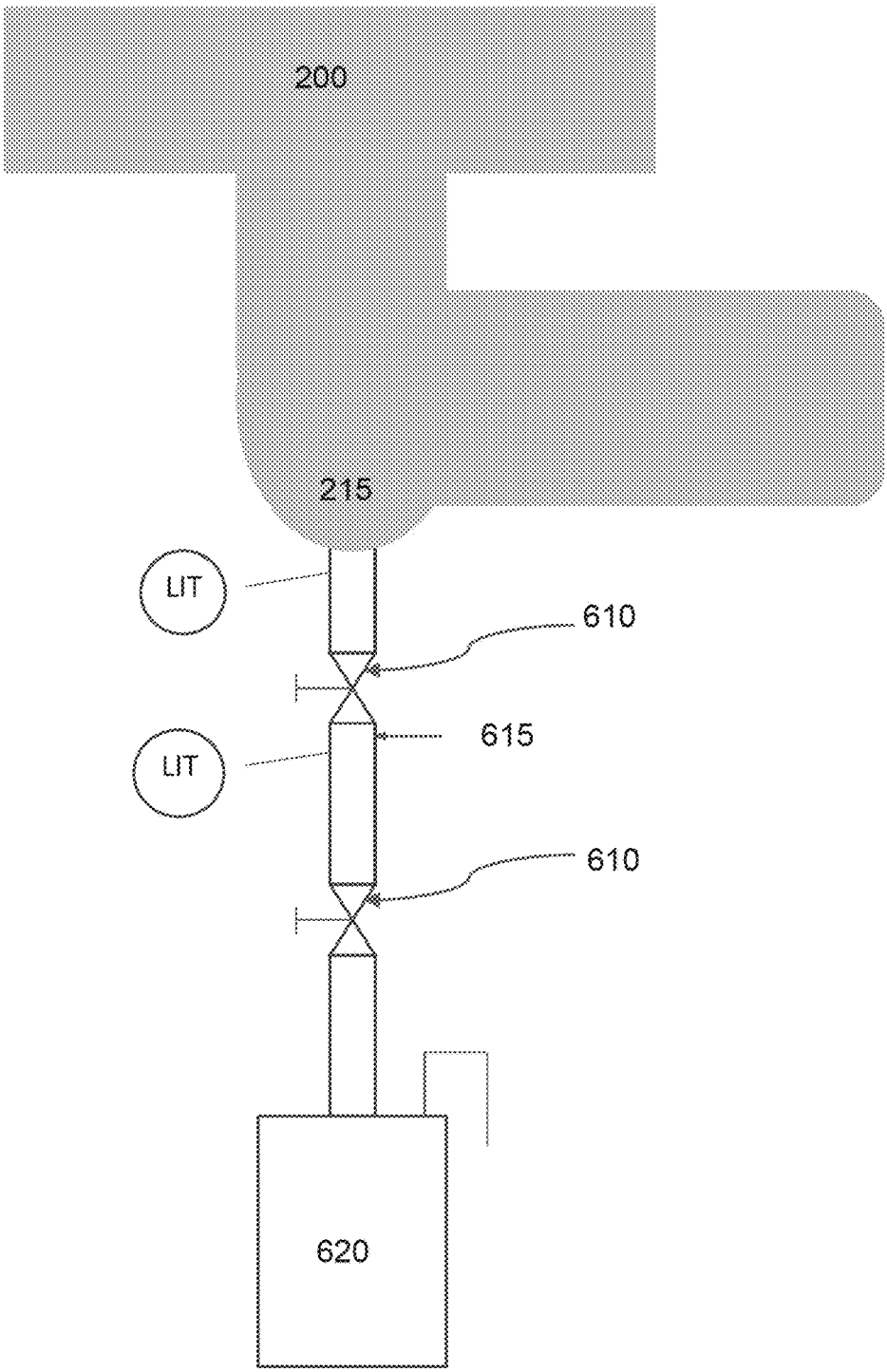
FIG. 6 is a schematic diagram of a grit removal system in accordance with one embodiment of the invention attached to the dirty gas output (215) of the heat exchanger (200). The grit removal system comprises a vertical pipe is equipped with two manually operated slide gate valves (610), $CO_2$ input and grit removal bin (620).

In one embodiment, as shown in FIG. 6, a vertical pipe is attached to the heat exchanger outlet duct where grit collects over time. The vertical pipe is equipped with two manually operated slide gate valves, with the top valve being left normally open. As the grit level in this pipe section increases over time, a high-level switch located in this pipe section will indicate and an operations worker will go to the grit removal system location to close the top valve and close the top valve. When the top valve is closed, the operator will add some $CO_2$ purge gas to dilute the syngas mixture with inert gas and the operator will open the bottom valve to drain the grit into a vented grit removal bin.

Once the grit has been emptied, the operator will close the bottom valve, then close the $CO_2$ purge and open the top valve.

Connection to Heat Exchanger

Connection of the grit injection apparatus to the heat exchanger and number of grit injection apparatus connected will depend on in part the configuration of the heat exchanger and gas flow characteristic in the upper plenum of the heat exchanger.

Figure 7:
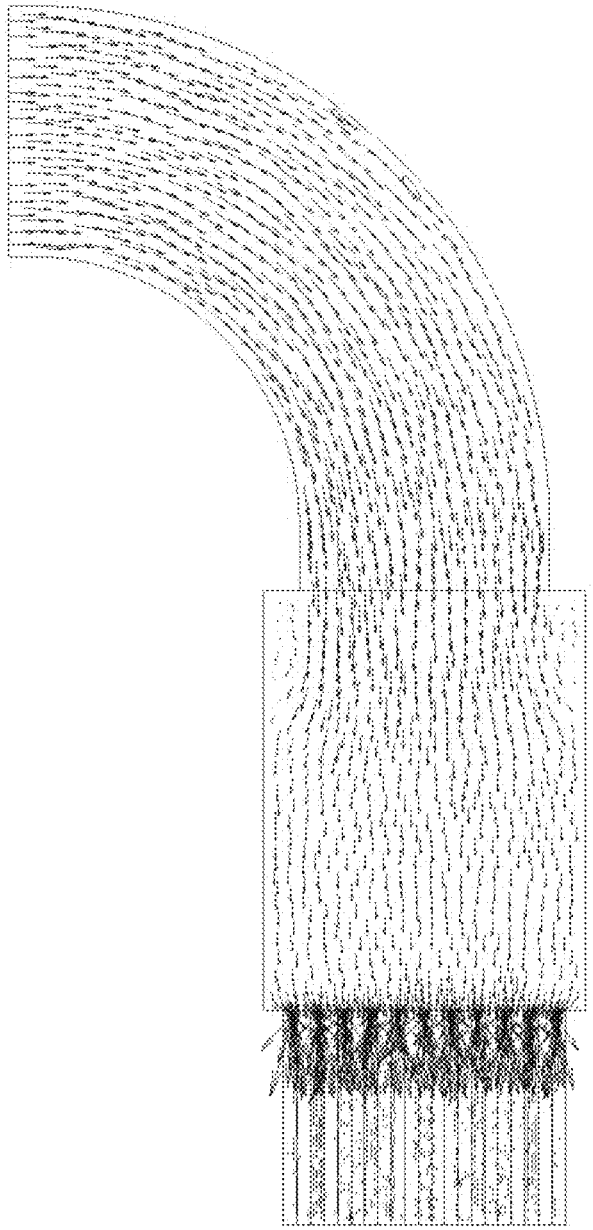
FIG. 7 illustrates a heat exchanger embodiment with gas inlet from a top elbow.

In some heat exchangers, as depicted in FIG. 7, the hot gas flow enters the top of the heat exchanger from an elbow. This creates a relatively uniform gas flow in the upper plenum.

Figure 8:
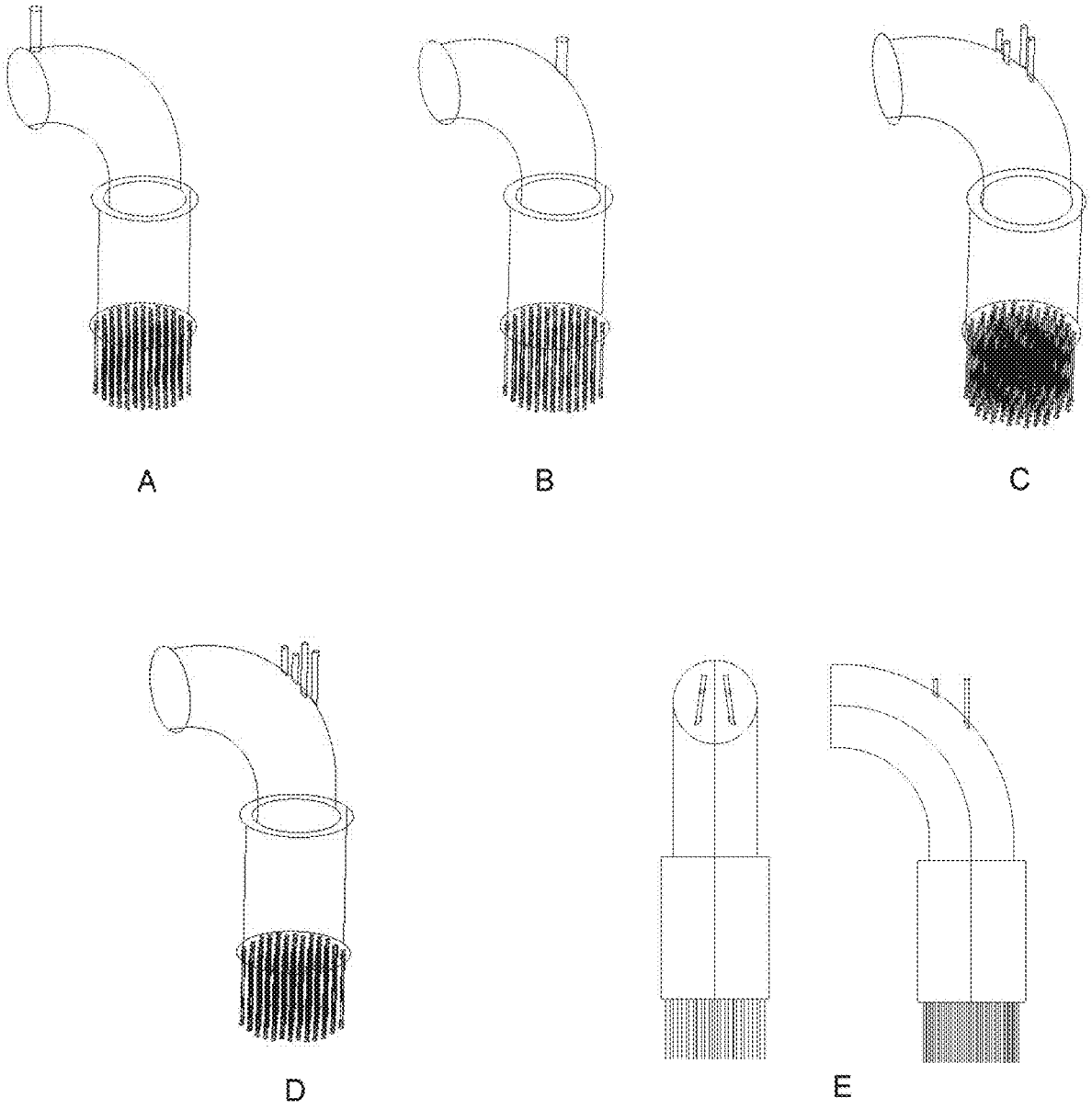
FIG. 8 depicts 5 permutations on grit inputs for a heat exchanger with top elbow entrance. A) configuration 1; B) configuration 2; C) configuration 3; D) configuration 4 and E) configuration 5.

For this design of heat exchanger, one or more grit inputs are provided along the elbow to release grit. Referring to FIG. 8, grit inputs can be provided at various locations and various numbers including a single centrally positioned input upstream of the inlet elbow (configuration 1); a single input positioned midway along the elbow such that it is axially parallel or aligned with the central axis of the heat exchanger (configuration 2); a set of four inputs where the centre point of the inputs is axially aligned with the central axis of the heat exchanger (configuration 3); a set of four inputs where the centre point of the inputs is axially parallel but not aligned with the central axis of the heat exchanger (configuration 4); four inputs positioned centrally midway along the inlet elbow where the centre point of the inputs is axially aligned with the central axis of the heat exchanger, the inputs are outwardly angled with respect to the heat exchanger axis and the two upstream inputs are moved closer to the inner side of the elbow (configuration 5).

Figure 9:
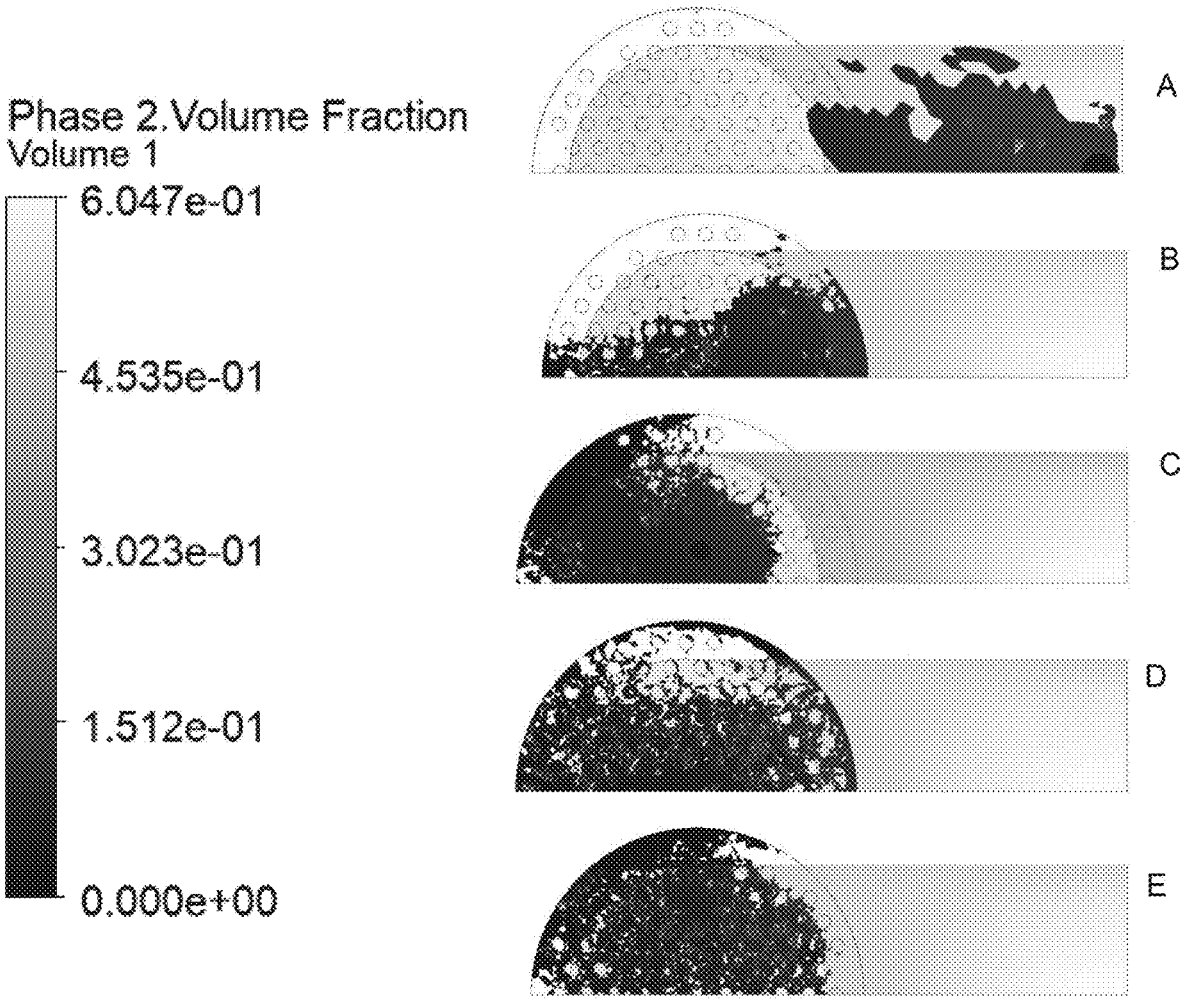
FIG. 9 shows grit distributions obtained for various permutations in a heat exchanger with elbow entry. A) configuration 1; B) configuration 2; C) configuration 3; D) configuration 4 and E) configuration 5.

Grit distribution obtained from CFD simulations for the various configurations are shown in FIG. 9 where the grit distribution across the upper tube sheet (view from top) is shown as iso-value contours of particles volume fraction. The simulation includes half of the geometry using the principle of symmetry. It can be seen how a significant level of improvement is achieved moving from Configuration 1 where the grit mostly lands on the inlet tube inner bend, towards Configuration 5 where a near complete coverage of the tube sheet is achieved.

Figure 10:
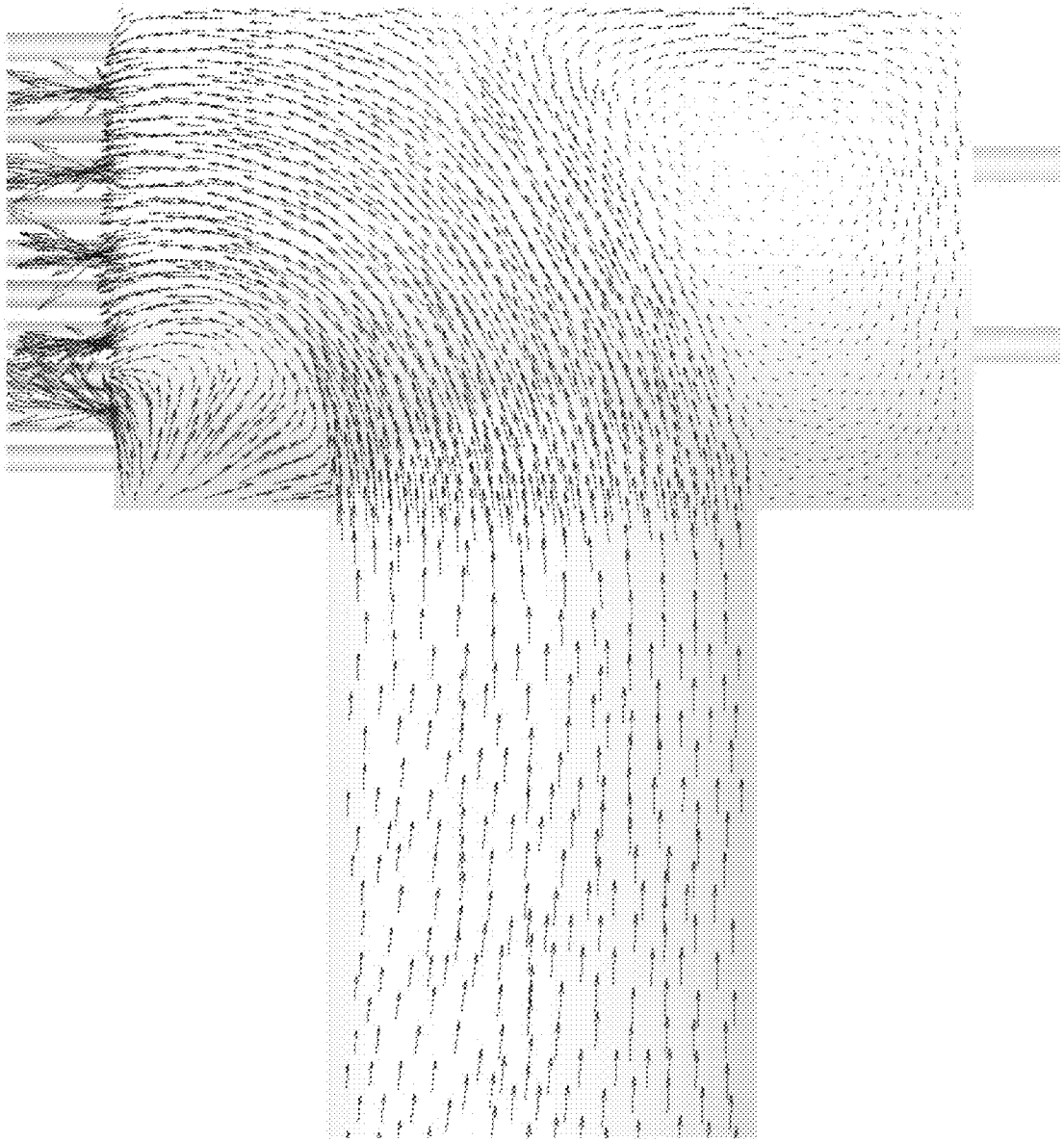
FIG. 10 shows a heat exchanger embodiment with gas inlet from the side.

In some heat exchangers, as depicted in FIG. 10, the gas flow enters the heat exchanger from a side inlet pipe. This creates a flow pattern that steeply changes its direction in the upper plenum to find its way to the tubes. As a result, recirculation patterns are formed.

Figure 11:
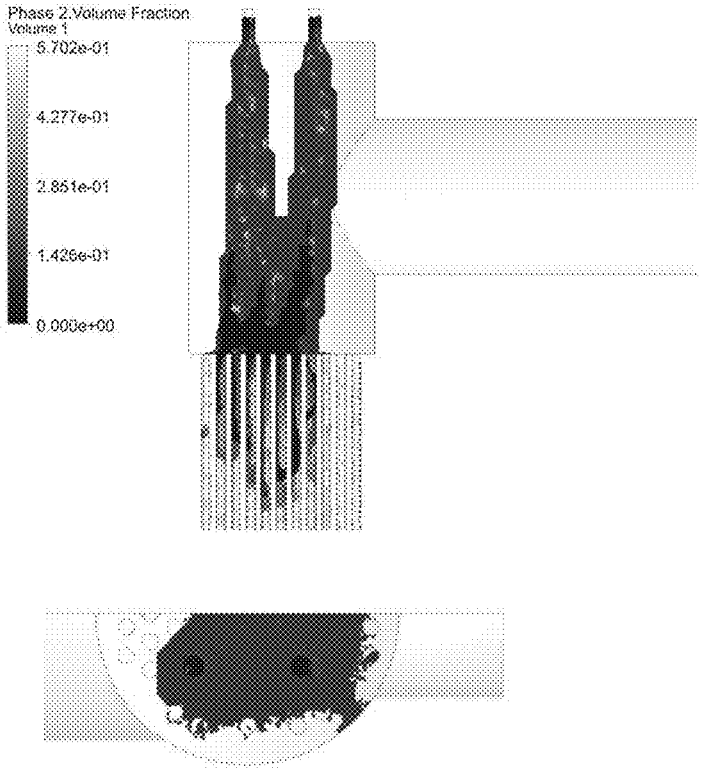
FIG. 11 illustrates grit distributions obtained for two permutations in a heat exchanger with side entry. A) coverage obtained with a 4-inch input. B) coverage obtained with a 6-inch input.
Figure 11:
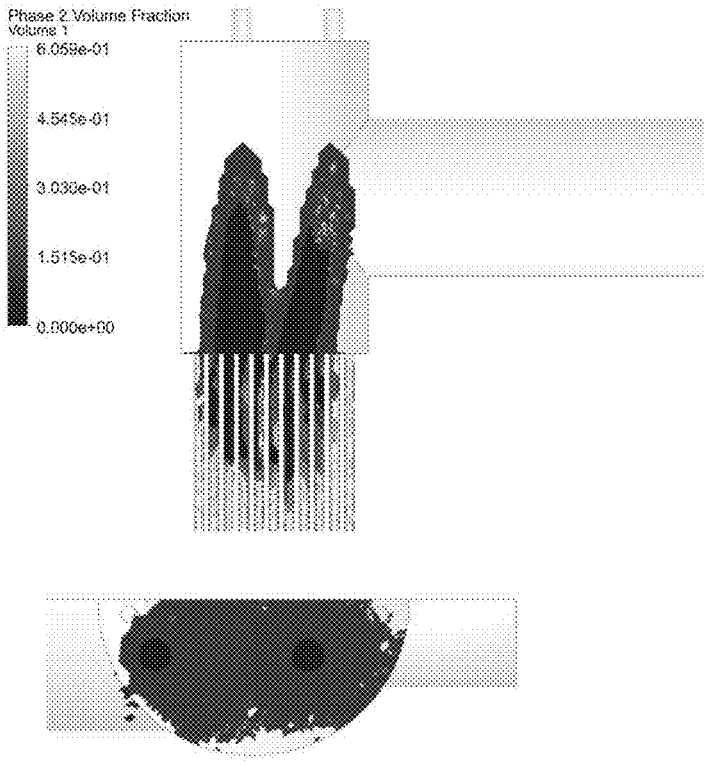

Referring to FIG. 10, grit inputs can be provided at various locations and various numbers, for example, tree permutations of the embodiment of FIG. 10 are equipped with a set of four inputs of 4-, 6- and 8-inch diameters, respectively. In some embodiments, two of the inputs are positioned closer to the inlet. FIG. 11 illustrates the grit distribution obtained from CFD simulation as iso-contours of particles volume fraction for two configurations with 4 and 6-inch inputs. In the configuration with 4-inch inputs, the inputs are centred, In the configuration with 6-inch inputs, the inputs are closer to the side inlet. A better coverage is obtained for the latter configuration.

In another example, the embodiment of FIG. 10 is equipped with a single 8-inch input positioned along the heat exchanger symmetry plane but moved toward the inlet duct.

In another example, the embodiment of FIG. 10 is equipped with three inputs in a triangular pattern. One input in on the symmetry line and the other two are off-center and at equal distances to the centre. In one embodiment the base of the triangle is on the inlet side. In another embodiment the triangle is rotated 180 degree such that its apex is near the inlet and its base is away from the inlet.

In one embodiment the input injected grit into the upper plenum with and initial velocity of 4 m/s. In another embodiment, the grit is injected into the upper plenum with an initial velocity of 10 m/s.

The input diameter is selected in relationship with the average grit particle size, particle size distribution and the diameter of the heat exchanger. The input minimum diameter should be at a minimum ten times particle diameter to prevent bridging or the particles in the input and plugging of the inputs. At a maximum, the input diameter can be up to half of the diameter of the heat exchanger. For example, in an embodiment with a heat exchanger diameter of 60 inches, average particle size of 2 mm, and maximum particle size of 4 mm, the minimum input diameter can be 20 mm, and the maximum can be 40 inches. A preferred range is two to 12 inches, and a more preferred range is 4 to 8 inches.

The number of inputs depends on the heat exchanger diameter, input diameter and input location. The number of puts can range from one to twelve or more. A more preferred number of inputs is between two and eight, and more preferably, between two and four. For example, in the embodiment of FIG. 5, four inputs are used. In the embodiment of FIG. 6, permutations of 2, three and four inputs are used.

Optionally, the process and system determine the flow of both gas streams. Accordingly, in some embodiments the flow of gas is determined using of calibrated flow devices.

Optionally, the process and system determine the composition of the gas streams is determined either by knowledge of the gas composition flowing on each side or by measurement of said composition.

Exemplary Embodiment

Figure 12:
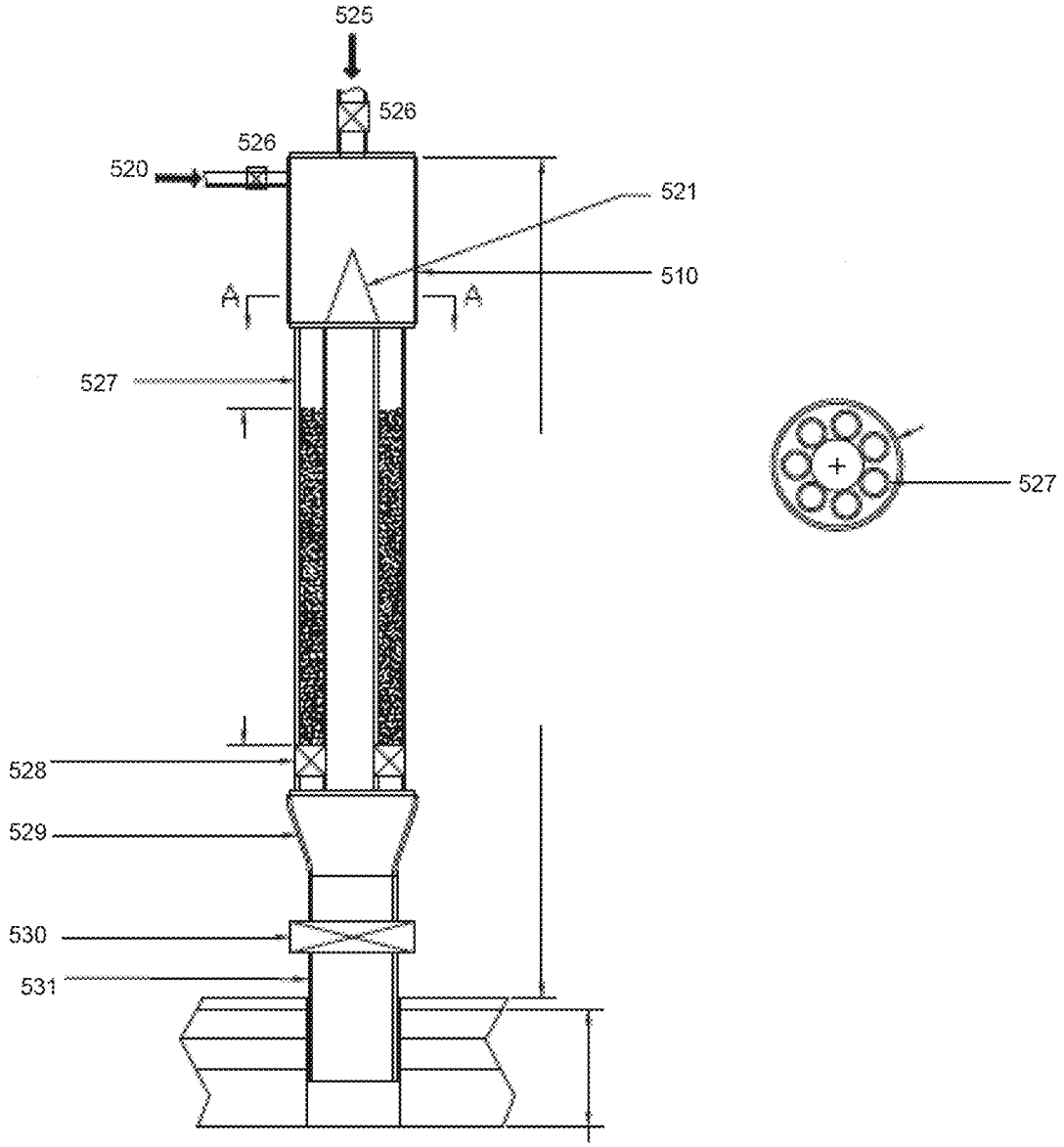
FIG. 12 illustrates one embodiment of the grit injection apparatus comprising a distribution and pressure charging hopper (510) operatively connected to a main hopper (not shown) and a pressurizing gas line (520) with valve (526). The connection (525) to the main hopper is equipped with a valve (526). The distribution and pressure charging hopper (510) includes a steel cone (521) to facilitate distribution of grit to the vertical pipes (527). Seven vertical pipes (527) (only two shown for clarity) extend from the distribution and pressure charging hopper outlet to a fast-acting valves (528) to facilitate pressurization. A reducer (529), isolation valve (530) and pipe (531) through insulation and refractory of heat exchanger to upper plenum of the heat exchanger are also shown.

Referring to FIG. 12, the heat exchanger has an internal diameter of 59 inches and tubes length of 14 m. The heat exchanger has a side inlet for the hot, dirty gases. It is a 48-inch diameter pipe. The inlet gas enters at a temperature of 1050° C. to 1100° C., high enough to keep salts and organics in the vapor phase. The upper plenum is 96 inches long. The inlet pipe is centred vertically along the plenum height.

Two grit inputs are placed along the heat exchanger central horizontal axis in the positions shown in FIG. 12. The grit inputs are placed along the heat exchanger symmetry line and are aligned with the inlet pipe. One grit input is placed close to the inlet pipe such that the centre of the input in at 10.5" from the edge of the heat exchanger plenum. The second grit input is placed away from the inlet such that its centre is at 10.5" from the opposite edge of the plenum.

The grit is made of a high purity quartz sand with specific gravity of 2.65, bulk density of 1522 kg/m$^3$, a median particle size of 1.70 mm and the following particle size distribution:

| Mesh Size | | |
|---|---|---|
| ASTM | Microns | |
| 8 | 2.36 mm | 4.4 |
| 12 | 1.70 mm | 76.9 |
| 16 | 1.18 mm | 17.5 |
| 20 | 850 | 0.3 |
| 30 | 600 | — |
| 40 | 425 | — |
| 50 | 300 | — |
| 70 | 212 | — |
| PAN | PAN | 0.8. |

The grit is transported above the heat exchanger in the following manner: Sacks of grit weighing approximately 1000 kg are loaded into a bulk-bag unloader stand, located at ground level, via a forklift. The bottom of the unloader stand contains a small hopper with an agitator installed to maintain easy grit discharge out of the hopper and into a flexible screw conveyor. An overall elevation change of approximately 30 meters is required to convey the grit to a set of 2 intermediate hoppers, located above the heat exchanger upper plenum.

The hoppers are sized such that they can hold sufficient grit to allow for 6 hours of holdup between refills. The preferred embodiment is designed for grit addition mass flow rate of 20 kg/hr of plant operation, and an approximate grit bulk density of 1522 kg/m 3 (95 lb/ft$^3$). This results in the need for approximately 21-gal holding capacity.

During the operating of the plant, an overall heat exchange coefficient is continuously calculated within the facility control system and when the heat exchange coefficient drops below a threshold value a grit addition sequence is initiated.

The control system sends a signal to the Grit Addition sequence controller to request grit. A section of pipe located on the outlet of the Grit Addition Hopper is filled with sand during a predetermined time by opening one of two gas-tight shut off valves to fill a section of pipe between two such valves.

When full, the top shut off valve is closed again, and the section of pipe will be pressurized to 15 psig with an inert gas such as $CO_2$ or steam.

In the system illustrated in FIG. 12, the grit injection apparatus comprises:

An upper valve,

A distribution and pressure charging hopper,

A vertical run of 7 2½ inch pipes circumferentially positioned and connected to the upper plenum, A line for pressurizing distribution hopper for sand injection, Fast acting valves on the lower end of the 2½ inch pipe segments for injecting sand at pressure, A 12×8-inch reducer, An 8-inch isolation placed valve downstream of the reducer, An 8-inch pipe segment below the isolation valve that is inserted into the plenum through a hole in the refractory.

There is provision for water cooling of this pipe segment as it is exposed to high temperatures of the upper plenum. Alternatively, an insulating sleeve is wrapped around the pipe segment for protection from high temperature.

For the start of an injection of grit, the isolation valve at the vessel is closed for normal operation. The fast-acting isolation valve located directly above this valve is also closed in order that the desired volume sand is held up above this valve when required. The valve from the pressurization line is also closed.

The valve from the metering line is opened and grit is metered from a main hopper into the distribution hopper by means of a metering valve by gravity feed from above. Once the required volume or level is achieved in the distribution hopper the metering valve is closed and the distribution hopper can be pressurized. The system is calibrated such that the required amount of the grit is predetermined from the duration of time the metering valve is open and the level of the grit in the main hopper. Minimum and maximum level switches are set in main hopper to limit variations in the quantity of the delivered grit. The pressure provides the motive force to inject the sand into the heat exchanger upper plenum. The system has provision for $CO_2$ and steam to be used as gas for pressurization.

Once 15 psig has been reached in the distribution hopper the supply valve for the gas is closed, the lower isolation valve is opened, and the fast-acting valve can be opened to discharge the sand. The sand is estimated to achieve a velocity of 10-15 m/s due to the driving force of the pressure in the hopper and the pipe.

After the sand has been discharged the isolation valve and the fast-acting valve are closed and the cycle can be repeated.

Figure 13:
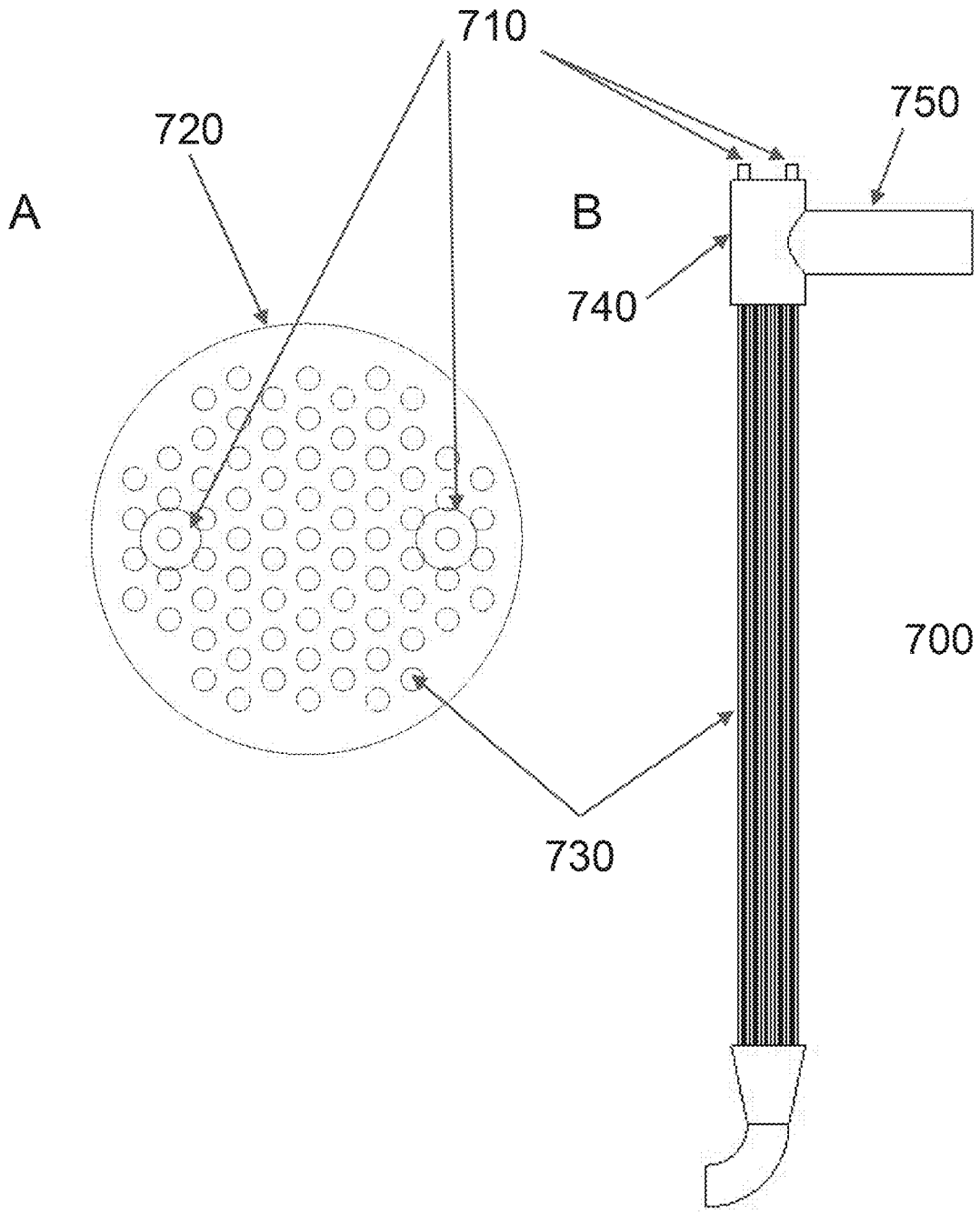
FIG. 13 illustrates one embodiment of a heat exchanger (700) with pipes from (710) two grit injection apparatus installed, detailing upper tube sheet (720), heat exchanger tubes (730), upper plenum (740), dirty hot gas inlet pipe (750).
Figure 14:
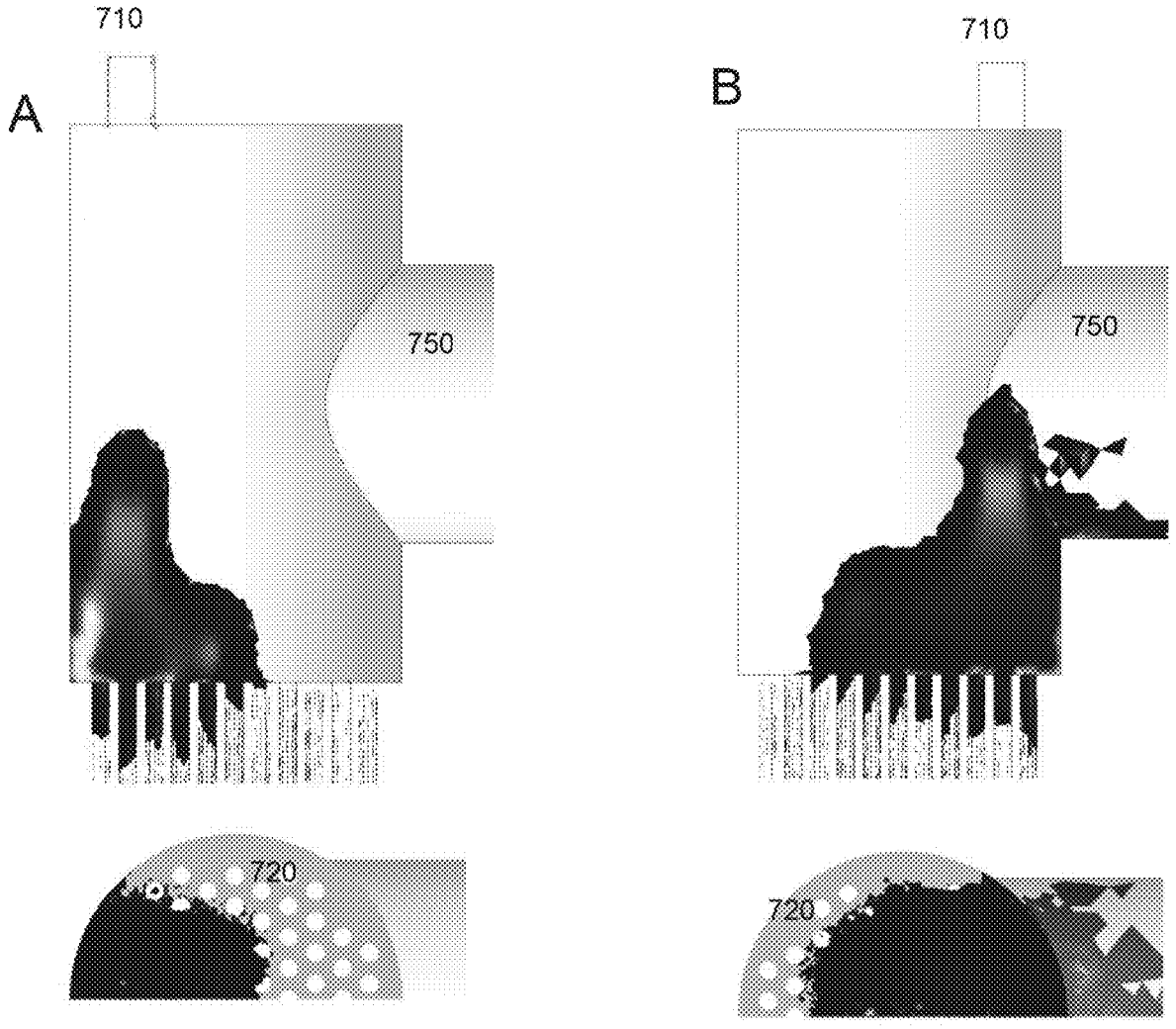
FIG. 14 shows grit distributions obtained for the embodiment of FIG. 12 and FIG. 13 plotted as contours of grit volume fraction. A) grit distribution from the outer pipe; B) grit distribution from the inner pipe.

The grit distribution obtained from sequential pressurization and injection from the two inputs are shown in FIG. 13. As can be seen, a good overall coverage is obtained.

Although the invention has been described with reference to certain specific embodiments, various modifications thereof will be apparent to those skilled in the art without departing from the spirit and scope of the invention. All such modifications as would be apparent to one skilled in the art are intended to be included within the scope of the following claims.

We claim:

1. A process for on-line prevention of fouling of a gas-to-gas heat exchanger wherein the gas-to-gas heat exchanger is a shell and tube gas-to-gas heat exchanger having a tube side and shell side, contaminated gas flows through the tube side and clean gas through the shell side, the process comprising:

a) measuring gas temperatures, composition and flowrates;

b) calculating a heat exchange coefficient from measured temperatures, composition and flowrates of gases in the gas-to-gas heat exchanger to obtain a measured heat exchange coefficient;

c) comparing the measured heat exchange coefficient to a predetermined heat exchange coefficient; and d) if measured heat exchange coefficient is less than the predetermined heat exchange coefficient, add grit to the contaminated gas;

wherein the contaminated gas has a flow velocity in the tubes sufficient for abrasive cleaning.

2. The process of claim 1, wherein the grit is pressurized grit or wherein the grit is provided as in a bag of friable material, as pellets or a compressed solid mass.

3. The process of claim 1, wherein step a) comprises:

measuring temperature of the contaminated gas entering the tube side of the gas-to-gas heat exchanger to obtain $T^{hot\ in}$;

measuring temperature of the contaminated gas exiting the tube side to obtain $T^{hot\ out}$;

measuring temperature of the clean gas entering the shell side to obtain $T^{cold\ in}$ measuring temperature of the clean gas exiting the shell side to obtain $T^{cold\ out}$ measuring the composition of the contaminated gas, measuring the flowrate of the contaminated gas; and measuring the flowrate of the clean gas.

4. The process of claim 3, wherein the heat exchange coefficient is calculated based on the equation:

$\mu=q/A$ LMTD, where $\mu$ is the overall heat transfer coefficient, q is the heat transferred, and LMTD is the Log Mean Temperature Differential and wherein the LMTD=$(\Delta T1-\Delta T2)/\ln((\Delta T1/\Delta T2)$, where $\Delta T1=T^{hot\ in}-T^{cold\ out}$ and $\Delta T2=T^{hot\ out}-T^{cold\ in}$.

5. The process of claim 1, wherein the heat exchange coefficient is calculated in real time.

6. The process of claim 5, wherein the predetermined heat exchange coefficient is a predetermined percentage of the heat exchange coefficient of the heat exchange in new condition; wherein the percentage is 70-95%.

7. The process of claim 1, further comprising repeating steps a) to d).

8. The process of claim 1, wherein the grit is hard with sharp edges, wherein the grit is sand, cyclone ash or slag particulates.

9. The process of claim 1, further comprising measuring gas velocity.

10. A system for on-line prevention of fouling of a gas-to-gas heat exchanger wherein the gas-to-gas heat exchanger is a shell and tube gas-to-gas heat exchanger having a tube side and shell side, contaminated gas flows through the tube side and clean gas through the shell side, the system comprising:

a grit injection apparatus, and;

a control system configured to:

receive temperature measurements of the contaminated gas and the clean gas, receive composition measurements of the contaminated gas and the clean gas, receive flowrate measurements of the contaminated gas and the clean gas, calculate a heat exchange coefficient from measured temperatures, composition and flowrates of gases in the gas-to-gas heat exchanger to obtain a measured heat exchange coefficient;

comparing the measured heat exchange coefficient to a predetermined heat exchange coefficient; and if measured heat exchange coefficient is less than the predetermined heat exchange coefficient, signal the grit injection apparatus to add grit to the contaminated gas;

wherein the temperatures are measured by a plurality of thermocouples.

11. The system for on-line prevention of fouling of the gas-to-gas heat exchanger of claim 10; wherein the grit injection apparatus comprises a distribution and pressure charging hopper operatively connected to a main hopper and a mechanical pressurization means or pressurizing gas line;

at least one vertical pipe extending from the distribution and pressure charging hopper;

wherein the distribution and pressure charging hopper and the at least one vertical pipe are configured to be pressurized; and a grit outlet pipe operatively connected to the at least one vertical pipe and extending into an upper plenum of the gas-to-gas heat exchanger;

wherein the grit injection apparatus is configured to provide pressurized grit to the upper plenum.

12. A heat exchange system comprising:

a shell and tube gas-to-gas heat exchanger having a tube side and shell side, wherein hot contaminated gas flows through the tube side and clean gas through the shell side;

at least one grit injection apparatus, each grit injection apparatus comprising a distribution and pressure charging hopper operatively connected to a main hopper and a mechanical pressurization means or pressurizing gas line;

at least one vertical pipe extending from the distribution and pressure charging hopper;

wherein the distribution and pressure charging hopper and the at least one vertical pipe are configured to be pressurized;

a grit outlet pipe operatively connected to the at least one vertical pipe and extending into an upper plenum of the shell and tube gas-to-gas heat exchanger;

wherein the grit injection apparatus is configured to provide pressurized grit to the upper plenum; and a control system configured to:

receive temperature measurements of the contaminated gas and the clean gas, receive composition measurements of the contaminated gas and the clean gas, receive flowrate measurements of the contaminated gas and the clean gas, calculate a heat exchange coefficient from measured temperatures, composition and flowrates of gases in the shell and tube gas-to-gas heat exchanger to obtain a measured heat exchange coefficient;

comparing the measured heat exchange coefficient to a predetermined heat exchange coefficient; and if measured heat exchange coefficient is less than the predetermined heat exchange coefficient, signal the grit injection apparatus to add grit to the contaminated gas.

13. The heat exchange system of claim 12, wherein the shell and tube gas-to-gas heat exchanger is a vertical heat exchanger.

14. The heat exchange system of claim 13, wherein the vertical heat exchanger has an axially aligned vertical inlet hot gas pipe and grit injection is into the axially aligned vertical inlet hot gas pipe.

15. The heat exchange system of claim 13, wherein the vertical heat exchanger has a side inlet hot gas pipe; wherein the grit injection apparatus is axially aligned with the vertical heat exchanger or wherein grit injection is into the side inlet hot gas pipe.

16. The heat exchanger system of claim 12, comprising at least two grit injection apparatus.

17. The heat exchanger system of claim 16, wherein the at least two grit injection apparatus are configured to distribute grit relatively uniformly across the whole cross section of the shell and tube gas-to-gas heat exchanger.

18. The heat exchanger system of claim 16, wherein the at least two grit injection apparatus are configured to distribute grit preferentially to heat exchange tubes that are prone to fouling.

* * * * *